US010948861B2

(12) United States Patent
Kimura et al.

(10) Patent No.: US 10,948,861 B2
(45) Date of Patent: Mar. 16, 2021

(54) IMAGE DISPLAY APPARATUS, IMAGE FORMING APPARATUS, AND NON-TRANSITORY COMPUTER READABLE MEDIUM STORING PROGRAM

(71) Applicant: FUJI XEROX CO., LTD., Tokyo (JP)

(72) Inventors: Takahiro Kimura, Kanagawa (JP); Keigo Okazaki, Kanagawa (JP); Shogo Fujita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/796,954

(22) Filed: Feb. 21, 2020

(65) Prior Publication Data

US 2021/0011411 A1 Jan. 14, 2021

(30) Foreign Application Priority Data

Jul. 12, 2019 (JP) ..... JP2019-129775

(51) Int. Cl.
*G03G 15/00* (2006.01)

(52) U.S. Cl.
CPC ..... *G03G 15/5016* (2013.01); *G03G 2215/00025* (2013.01); *G03G 2215/0404* (2013.01); *G03G 2215/0414* (2013.01)

(58) Field of Classification Search
CPC ..... G03G 15/5016; G03G 2215/00025; G03G 2215/0404; G03G 2215/0414; B41J 29/38; B41J 29/42; G06F 1/3231; G06F 3/048; G06F 3/12; G06F 3/1229; H04N 1/32101; G06K 9/00369; G06K 15/1809
See application file for complete search history.

(56) References Cited

U.S. PATENT DOCUMENTS

2009/0219588 A1* 9/2009 Nakai ..... B41J 3/46 358/527
2011/0254846 A1* 10/2011 Lee ..... H04N 21/4223 345/427
2012/0293405 A1* 11/2012 Iida ..... H04N 21/4223 345/156
2015/0227328 A1* 8/2015 Yokoyama ..... G06F 3/1229 358/1.14
2015/0261168 A1* 9/2015 Yokoyama ..... G03G 15/5016 399/81
2016/0150121 A1* 5/2016 Idehara ..... H04N 1/32101 358/1.15
2017/0013141 A1* 1/2017 Ishimitsu ..... G03G 15/5016
2018/0041655 A1* 2/2018 Nakajima ..... G06F 1/3231
2018/0284672 A1* 10/2018 Saeda ..... G06K 15/1809

FOREIGN PATENT DOCUMENTS

JP 2018134850 8/2018

* cited by examiner

*Primary Examiner* — Sophia S Chen
(74) *Attorney, Agent, or Firm* — JCIPRNET

(57) ABSTRACT

An image display apparatus includes a display section that displays an image provided on an apparatus main body, a detection section that detects a location of a user with respect to the apparatus main body, and a change section that changes an image to be displayed on the display section from an image for a first location to an image for a second location, the image for the first location and the image for the second location being images having an identical attribute, in a case where the location of the user, which is detected by the detection section, is changed from the first location to the second location.

6 Claims, 19 Drawing Sheets

INFORMATION QUANTITY: SMALL

INFORMATION QUANTITY: MIDDLE

INFORMATION QUANTITY: LARGE

IMAGE DISPLAY APPARATUS, IMAGE FORMING APPARATUS, AND NON-TRANSITORY COMPUTER READABLE MEDIUM STORING PROGRAM

CROSS-REFERENCE TO RELATED APPLICATIONS

This application is based on and claims priority under 35 USC 119 from Japanese Patent Application No. 2019-129775 filed Jul. 12, 2019.

BACKGROUND

(i) Technical Field

The present invention relates to an image display apparatus, an image forming apparatus, and a non-transitory computer readable medium storing a program.

(ii) Related Art

In the related art, an apparatus, such as an image forming apparatus, is already suggested which is configured to enable a user to check information relevant to a state of the image forming apparatus from a distance through visual observation in order to improve convenience in a case where the user uses the apparatus (JP2018-134850A).

JP2018-134850A includes an image forming apparatus, a display apparatus, and an information processing apparatus, and is configured such that the image forming apparatus is provided with a transmission section that transmits state data indicative of a state of the image forming apparatus to the information processing apparatus before the image forming apparatus becomes a sleep mode, and the information processing apparatus is provided with a reception section that receives the state data and a display control section that displays a state screen which shows the state on the display apparatus based on the state data.

SUMMARY

Aspects of non-limiting embodiments of the present disclosure relate to an image display apparatus, an image forming apparatus, and a non-transitory computer readable medium storing a program, which change an image displayed on a display section according to a location of a user, compared to a case where an identical image is displayed on the display section regardless of the location of the user.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image display apparatus including a display section that is provided on an apparatus main body and displays an image, a detection section that detects a location of a user with respect to the apparatus main body, and a change section that changes an image to be displayed on the display section from an image for a first location to an image for a second location, the image for the first location and the image for the second location being images having an identical attribute, in a case where the location of the user, which is detected by the detection section, is changed from the first location to the second location.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described with reference to the accompanying drawings.

First Exemplary Embodiment

Figure 1:
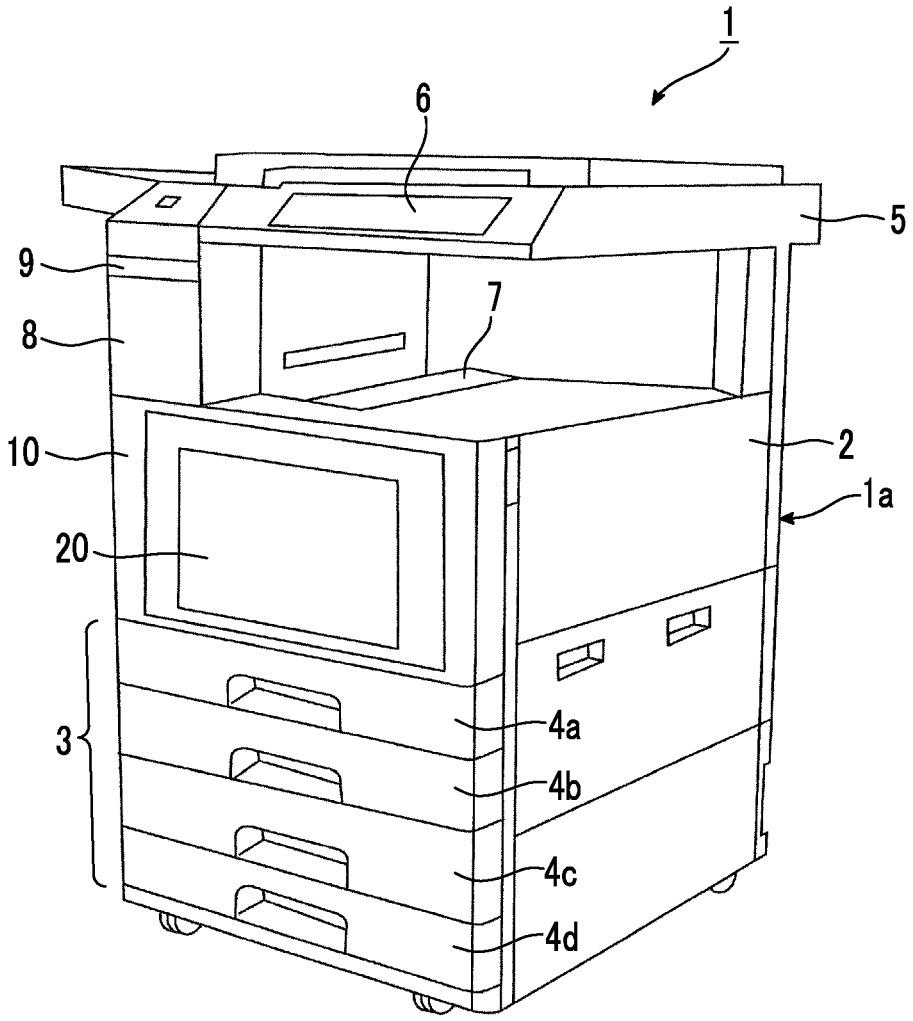
FIG. 1 is a perspective configuration diagram illustrating an overview of a whole image forming apparatus to which an image display apparatus according to a first exemplary embodiment is applied.

FIG. 1 illustrates an overview of a whole image forming apparatus to which an image display apparatus according to a first exemplary embodiment is applied.

Configuration of Whole Image Forming Apparatus

An image forming apparatus 1 according to the first exemplary embodiment is configured as a color printer using, for example, an electro-photographic method. As illustrated in FIG. 1, the image forming apparatus 1 includes an apparatus main body 1*a* which is configured with a frame, an exterior cover, and the like. An upper part 2 of the apparatus main body 1*a* is disposed with a not-shown image forming section including a plurality of image formation devices, which form toner images developed by toners that constitute a developer, an intermediate transfer device, and the like, therein. A lower part 3 of the apparatus main body 1*a* is provided with a plurality of (four in an example of the drawing) paper feed trays 4*a* to 4*d* for accommodating recording sheets as an example of a recording medium on which an image is formed by the image forming section and which has various sizes and materials.

In addition, at an upper end of the apparatus main body 1*a* of the image forming apparatus 1, an image reading device 5 is disposed as an image reading section that reads an image of a document, on which the image is formed, in the image forming apparatus 1. A front side (front surface side) of the image reading device 5 constitutes a manipulation panel 6 which is a User Interface (UI) manipulated by a user who uses the image forming apparatus 1. In addition, a body inside ejection-type sheet ejection part 7 is provided which ejects not-shown recording sheets, on which the image is formed by the image forming section, between the upper part 2 of the apparatus main body 1*a* and the image reading device 5. A sheet conveyance part 8 for ejecting the not-shown recording sheets, on which the image is formed by the image forming section, to the sheet ejection part 7, is disposed between a one side (a left side on the example of the drawing) of the upper part 2 of the apparatus main body 1*a* and the image reading device 5.

Configuration of Image Display Apparatus

The image forming apparatus 1 is installed in, as well as a general office, various places, such as a convenience store, a hospital, and a public office, on a street, and is used as a multi-functional apparatus which performs various functions of copying a document, printing image information, reading image information of a FAX or a document, and the like.

In a case where characteristics as the multi-functional apparatus installed in various places as above is focused, the image forming apparatus 1 according to the first exemplary embodiment is allowed to be used as a so-called "digital signage" that has a function as the image display apparatus which displays images for news, weather forecast, guidance, advertisements, and publicity, and which provides information, as well as information related to the image forming apparatus 1, toward a user who uses the image forming apparatus 1, and, further, a user who exists in the vicinity of the image forming apparatus 1 in a wide meaning.

As illustrated in FIG. 1, on the front surface of the apparatus main body 1*a* of the image forming apparatus 1, a front cover 10 as an example of a closing and opening section, which covers the upper part 2 embedded with the image forming section, is provided to be open and close. In the image forming apparatus 1, the front cover 10 is open and close in a case of necessity, that is, in a case where toner cartridges, which accommodate toners of respective colors including a color of yellow (Y), a color of magenta (M), a color of cyan (C), and a color of black (K) for forming a full color image, are exchanged, in a case where jam, such as paper jam of the recording sheets, occurs in the image forming section, or the like.

On a surface of the front cover 10, a display panel 20, as an example of a display section, is attached toward a front surface which is one side surface of the apparatus main body 1*a*. The display panel 20 includes, for example, a liquid crystal display of a 15.6 inch, an organic Electronic Luminescent (EL) display, or the like. The display panel 20 displays an image including various pieces of information as well as image information relevant to the image forming apparatus 1.

Figure 2A:
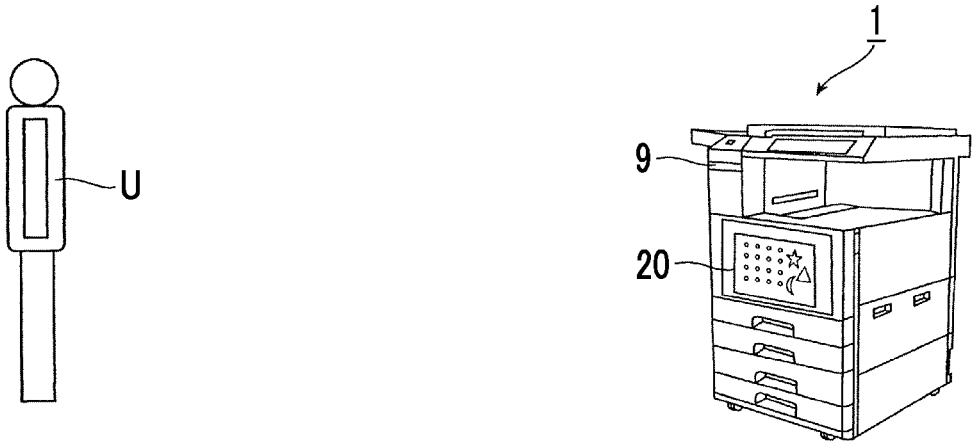
FIG. 2A is a schematic diagram illustrating a relation between the image forming apparatus, to which the image display apparatus according to the first exemplary embodiment is applied, and a user.
Figure 2B:
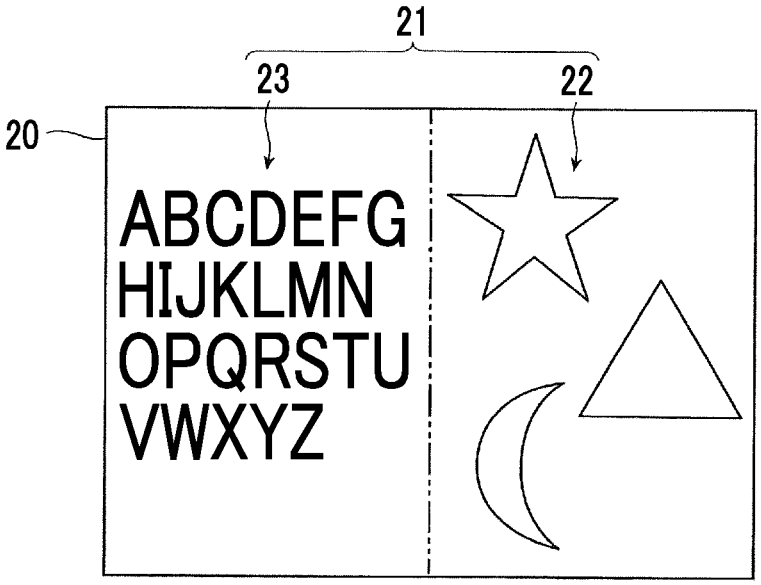
FIG. 2B is a configuration diagram illustrating an image displayed on a display panel.

However, as illustrated in FIGS. 2A and 2B, even though the image displayed on the display panel 20 is useful for a user U, in a case where an identical image is always displayed regardless of a locational relation between the image forming apparatus 1, to which the display panel 20 is attached, and the user U, there is a case where it is difficult for the user U to visually recognize the image displayed on the display panel 20 through visual observation as in a case where a location of the user U is separated from the image forming apparatus 1. In contrast, in a case where the image displayed on the display panel 20 is enlarged so as to be visually recognized from a separated distance by taking a case where a distance between the image forming apparatus 1 and the user U is separated into consideration, it is easy for the user U to visually recognize the image. In contrast, content to be displayed is limited as much as display is performed after enlarging a size of text or a picture of the image displayed on the display panel 20, and thus it is difficult to provide sufficient image information to the user U.

Here, the image forming apparatus 1, to which the image display apparatus according to the first exemplary embodiment is applied, is configured to include a human detection sensor 30 (refer to FIGS. 5A and 5B) as an example of a detection section which detects the location of the user U with respect to the apparatus main body 1*a*, and a control unit 101 (refer to FIG. 7) as an example of an change section which changes the image displayed on the display panel 20 from an image for a first location to an image for a second location, the images having an identical attribute, in a case where the location of the user U detected by the human detection sensor 30 is changed from the first location to the second location.

As described above, the image displayed on the display panel 20 includes various images for the news, the weather forecast, the guidance, the advertisement, the publicity, and the like, as well as information for urging to exchange the toner cartridges relevant to the image forming apparatus 1, replenishment of the recording sheets, or the like. FIG. 2B illustrates an entirety of an image 21 displayed on the display panel 20, as an example. The image 21 generally includes a picture image 22, which includes a figure, a photo, an illustration, or the like, and a text image 23 which includes text (including a number, a symbol, or the like). In a case where the user U exists in a location in a vicinity of the apparatus main body 1*a* of the image forming apparatus 1, an entirety (all) of the image 21, which should be displayed on the display panel 20, is displayed, as illustrated in FIG. 2B. The image 21 displayed on the display panel 20 is not limited to an image including one page, and may be an image including a plurality of pages. Further, the image 21 displayed on the display panel 20 is not limited to a still image, and may be a moving image. Meanwhile, the image 21 may be either monochrome or color.

Figure 3:
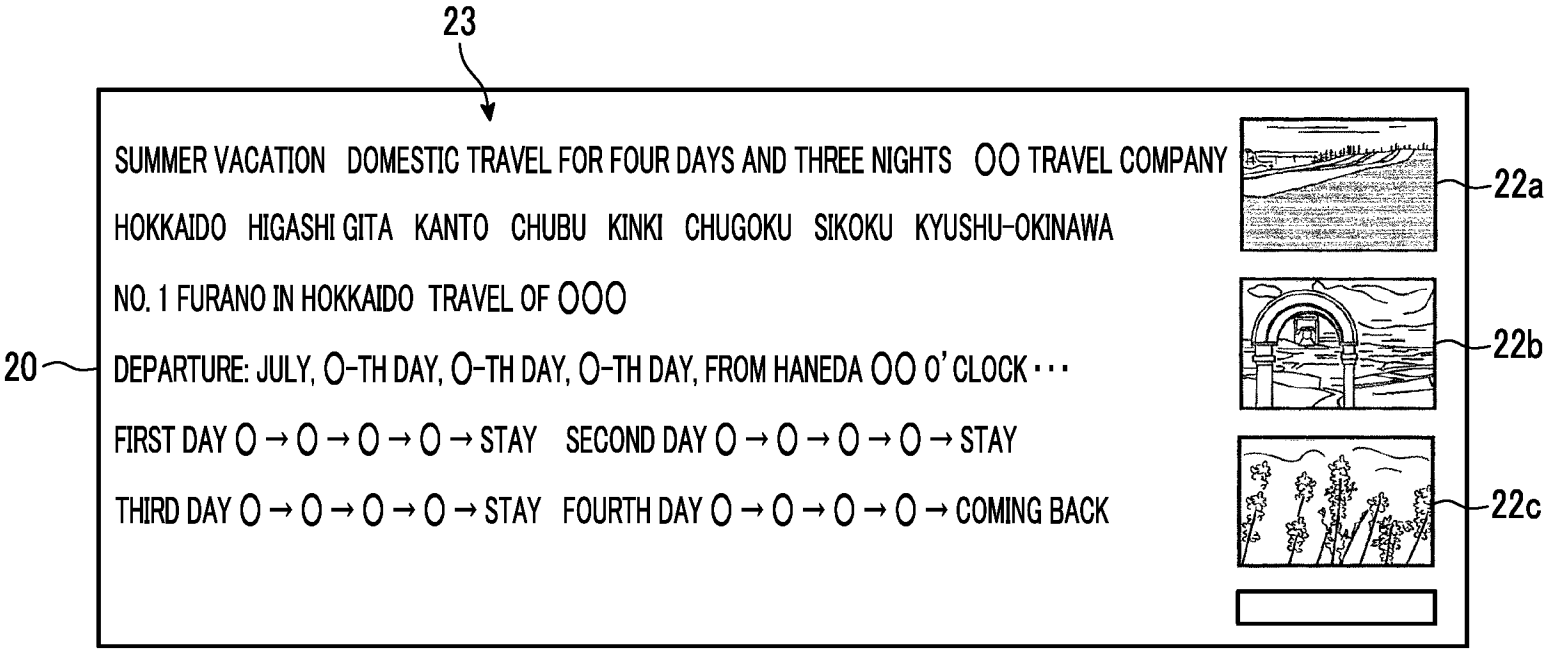
FIG. 3 is a schematic configuration diagram illustrating the image displayed on the display panel.

For easy understanding of the first exemplary embodiment, a detailed example of the image 21 displayed on the display panel 20 will be described. For example, as illustrated in FIG. 3, in addition to the text image 23 which shows advertisement of travel, such as a slogan or a company name, that is, "summer vacation", "domestic travel for four days and three nights", and "Go travel company", the text image 23 is provided which includes further detailed regions such as, "Hokkaido, Higashi Gita, Kanto, Chubu, Kinki, Chugoku, Shikoku, and Kyushu-Okinawa", a number indicative of a number of the advertisement, such as "No. 1 Furano in Hokkaido, travel of ○○○", "departure: July, ○-th day, ○-th day, ○-th day, from Haneda, ○○ o'clock, . . . ", a destination, a detailed schedule of the travel. In addition, as a detailed example of the picture image 22 in the image 21 displayed on the display panel 20, for example, it is possible to provide images, which are considered to attract an interest of the user U, such as picture images 22*a*, 22*b*, and 22*c* which include photos of lavender fields of Furano in Hokkaido, photos of other tourist spots, or illustrations.

As being in the detailed example, the image 21 displayed on the display panel 20 includes, in addition to the text image 23, such as "summer vacation" or "domestic or abroad travel for four days and three nights", which should be delivered to the user who views the image 21 as a whole and which has solicitation, detailed text image 23 which is useful for the user who has an interest in the travel and which includes the regions, such as "Hokkaido, Higashi Gita, Kanto, Chubu, Kinki, Chugoku, Shikoku, and Kyushu in the country", indicative of content of the travel in detail, and "Furano in Hokkaido, travel of ○○○", "departure: July, ○-th day, ○-th day, and ○-th day, from Haneda at ○○ o'clock, . . . " indicative of a further example of the travel. However, it is difficult to visually recognize the detailed text image 23 in a case where the user U is separated from the image forming apparatus 1.

Figure 4A:
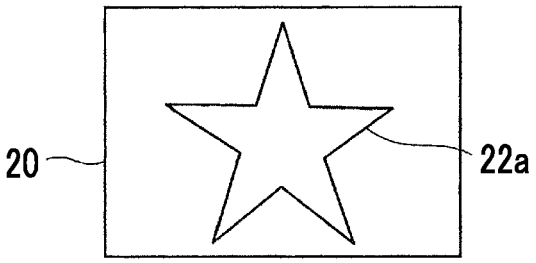
FIGS. 4A to 4C are schematic configuration diagrams illustrating the image displayed on the display panel.

Therefore, in a case where the user U is separated from the image forming apparatus 1, it is available to select, enlarge, and display the picture image 22, which most attracts the interest of the user U, such as the picture image 22*a* which is the photo of the lavender field in Furano in Hokkaido, as illustrated in FIG. 4A. In addition, the picture image 22, which most attracts the interest of the user U, such as the picture image 22*a* which is the photo of the lavender field in Furano in Hokkaido, as illustrated in FIG. 4A, is not limited to one image, and a plurality of images may be sequentially switched and displayed in a slide format. In addition, in a case where the user U exists in a location which is relatively close to the image forming apparatus 1, for example, it is preferable to simultaneously display the plurality of picture images, which include photos or illustrations of the tourist spots in Hokkaido to be considered to attract the interest or concern of the user U, such as the picture images 22*a*, 22*b*, and 22*c* which are the plurality of photos of the lavender field in Furano in Hokkaido, as illustrated in FIG. 4B.

Figure 4B:
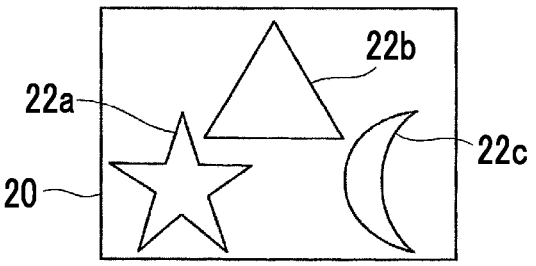
Figure 4C:
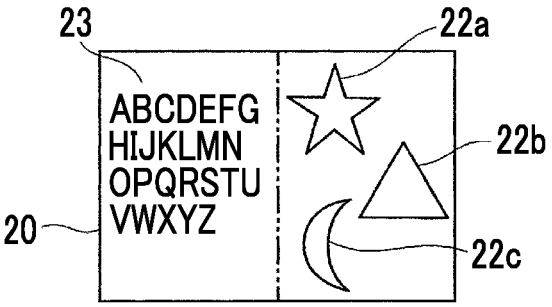

Further, in a case where the user U exists in the vicinity of the image forming apparatus 1, it is further effective to display the text image 23, which includes a suggestion of the ○○ travel company relevant to the domestic travel for four days and three nights in summer vacation, in addition to the picture images 22*a*, 22*b*, and 22*c*, as illustrated in FIG. 4C.

At this time, the image 21, which is displayed on the display panel according to the location of the user U and is illustrated in FIGS. 4A to 4C, is an image which relates to one theme of the "domestic travel for four days and three nights" of the "summer vacation" and belongs to an identical attribute. The attribute refers to a feature and a property of the image (Kojien (Japanese Dictionary) 9 of the fourth version). Here, the identical attribute includes attributes, which are related with each other, as well as a case of the same attribute. The image 21, which has the identical attribute, includes images which have a relation of an entirety and a part, and images which have a relation of images as the entirety and an enlarged part, the entirety and an extracted part, or the like.

Here, FIG. 4C illustrates the whole image 21 to be displayed on the display panel 20, FIG. 4B illustrates only the enlarged picture images 22*a*, 22*b*, and 22*c* which are partial images of the whole image 21 to be displayed on the display panel 20, and FIG. 4A illustrates only the further enlarged one (partial) picture image 22*a* of the picture image 22 which is the partial image of the whole image 21 to be displayed on the display panel 20. The picture image illustrated in FIG. 4A has a larger magnification than the picture image illustrated in FIG. 4B.

In addition, in a case where a relation of the image 21, which has the identical attribute and is illustrated in FIGS. 4A to 4C is focused, it is possible to mention that FIG. 4B illustrates an image acquired by enlarging apart of the picture image 22 of the whole image of FIG. 4C, and FIG. 4A illustrates an image acquired by further enlarging the part of the picture image 22 of FIG. 4B. However, in a case where the relation of each image illustrated in FIGS. 4A to 4C is viewed, a part of the image is not simply enlarged, and a specific part is extracted and is enlarged after a disposition thereof is further changed.

Figure 5A:
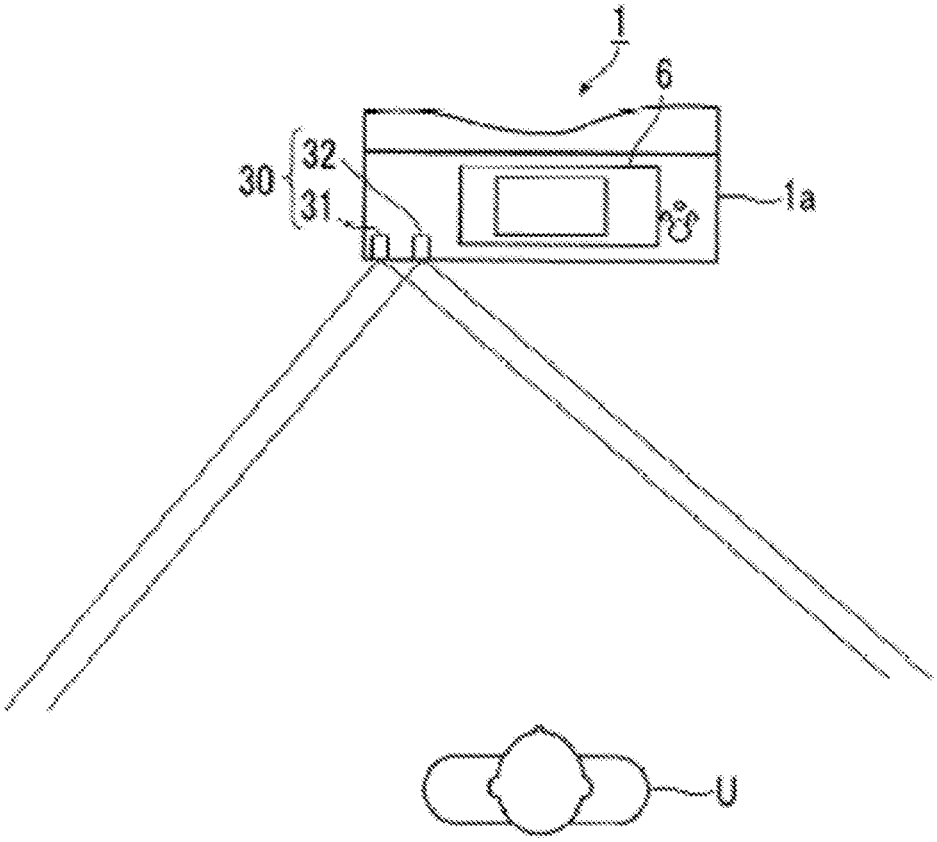
FIGS. 5A and 5B are schematic configuration diagrams respectively illustrating a human detection sensor.
Figure 5B:
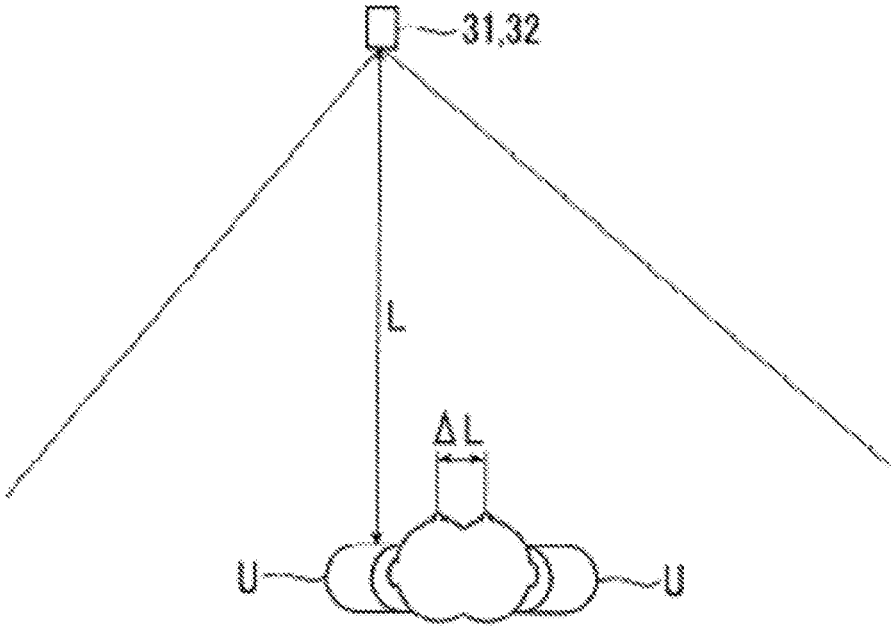

As illustrated in FIGS. 5A and 5B, as the human detection sensor 30, for example, first and second cameras 31 and 32, which capture a video of a vicinity (front) of the apparatus main body 1*a* of the image forming apparatus 1, are used. The first and second cameras 31 and 32 are disposed in a state of being embedded in a detection window 9 on a front surface of the sheet conveyance part 8 provided on one side (left side in the example of the drawing) of the apparatus main body 1*a*, as illustrated in FIG. 1. The detection window 9 is formed of a deflection filter or the like whose outside is viewed from an inside but the inside is not viewed from the outside. With regard to the video captured by the first and second cameras 31 and 32, an image of the user U is determined as an image separated by ΔL through image processing, as illustrated in FIG. 5B, and a distance (location) L, a direction, or the like of the user U with respect to the apparatus main body 1*a* of the image forming apparatus 1 is measured by a measurement unit 111 (refer to FIG. 7), which will be described later, using a third angle projection method or the like. The measurement unit 111 may measure only the distance L up to the user U with respect to the apparatus main body 1*a* of the image forming apparatus 1.

Figure 6A:
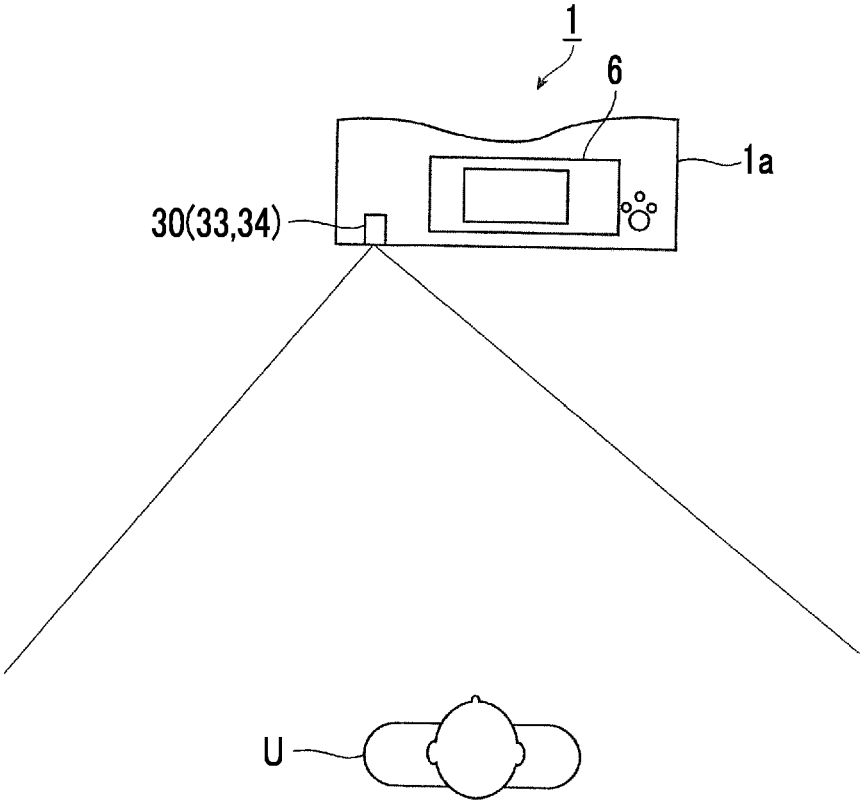
FIGS. 6A and 6B are schematic configuration diagrams respectively illustrating the human detection sensor.
Figure 6B:
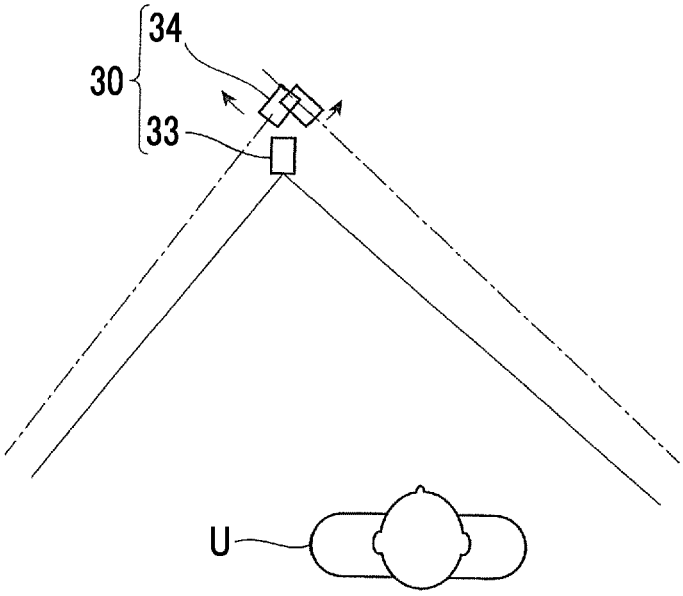

In a case where it is possible to detect the location of the user U with respect to the apparatus main body 1*a* of the image forming apparatus 1, it is possible to use various sensors as the human detection sensor 30, in addition to the cameras. As the human detection sensor 30, a combination of a pyroelectricity sensor 33, which detects existence/non-existence of the user U with respect to the apparatus main body 1*a* of the image forming apparatus 1 using infrared light, and a distance sensor 34 which measures a distance from the user by outputting laser beams, visual light, infrared light, ultrasonic waves, or the like and receiving the laser beams, the visual light, the infrared light, the ultrasonic waves, or the like reflected by the user, as illustrated in FIGS. 6A and 6B. However, in many cases, the distance sensor 34, which measures the distance from the user U using the laser beams, the ultrasonic waves, or the like, has a narrow detectable range (detection angle). In a case where the distance sensor 34 is used through the combination with the pyroelectricity sensor 33 which detects the existence/non-existence of the user U and the pyroelectricity sensor 33 detects the user U, it is preferable to measure the distance L from the user U by moving the distance sensor 34, which uses the laser beams, the ultrasonic waves, or the like, in a horizontal direction by a required angle.

A detection distance of the human detection sensor 30 is, for example, at least 3 m, preferably, 5 m, and, more preferably, is equal to or longer than 5 m. The image displayed on the display panel 20 includes various images, for example, for a purpose of the publicity, the advertisement, or the like, and it is preferable to widely detect the user U who has a possibility to pass in the vicinity of the image forming apparatus 1 and to visually observe the display panel 20 of the image forming apparatus 1 while not being limited to the user U who directly use the image forming apparatus 1, and to display the image 21 on the display panel 20 according to the location of the user U. Even in a case of the user U who is separated from the image forming apparatus 1 to be equal to or longer than 5 m, it is possible to visually recognize the image 21 sufficiently according to a method for displaying the image 21 on the display panel 20, and thus it is preferable that the detection distance of the human detection sensor 30, for example, is equal to or longer than 5 m.

In a case where the user U is detected by the human detection sensor 30, it is possible to check whether or not the user U exists in the vicinity of the image forming apparatus 1 and to measure the distance up to the user U. It is possible for the user who exists in the vicinity of the image forming apparatus 1 to visually recognize the image 21 displayed on the display panel 20. In addition, in a case where the user U approaches the apparatus main body 1*a* of the image forming apparatus 1, it becomes further easy to visually recognize the image 21 displayed on the display panel 20.

Here, the first exemplary embodiment is configured such that, in a case where the location of the user U, which is detected by the human detection sensor 30, is changed from the first location to the second location, the control unit 101, which functions as the change section, changes the image 21 displayed on the display panel 20 from the image for the first location to the image for the second location, the images having the identical attribute.

Here, a case where the location of the user U is changed from the first location to the second location includes, as well as a case where the location of the user U, which is detected by the human detection sensor 30 from the first, is changed from the first location to the second location, a case where the user U who is not detected by the human detection sensor 30 at first is detected by the human detection sensor 30, that is, a case where the first location which is not detected is changed to the second location which may be detected. That is, it is not necessary that the user U in the first exemplary embodiment is a specific user U. In other words, the case where the location of the user U is changed from the first location to the second location includes, as well as a case where a location of the user U who exists in the first location at first is changed to the second location, a case where a location of a user U who is different from the user U who exists in the first location at first, that is, a new user U who is not detected by the human detection sensor 30 at first is changed to the second location. The first exemplary embodiment concerns a problem whether or not the user U is capable of visually recognizing the display panel 20 of the image forming apparatus 1. Therefore, the existence/non-existence of the user U who may visually recognize the display panel 20 of the image forming apparatus 1 and a change in the location of the user U who may visually recognize the display panel 20 of the image forming apparatus 1 are taken into consideration.

Configuration of Control Apparatus

Figure 7:
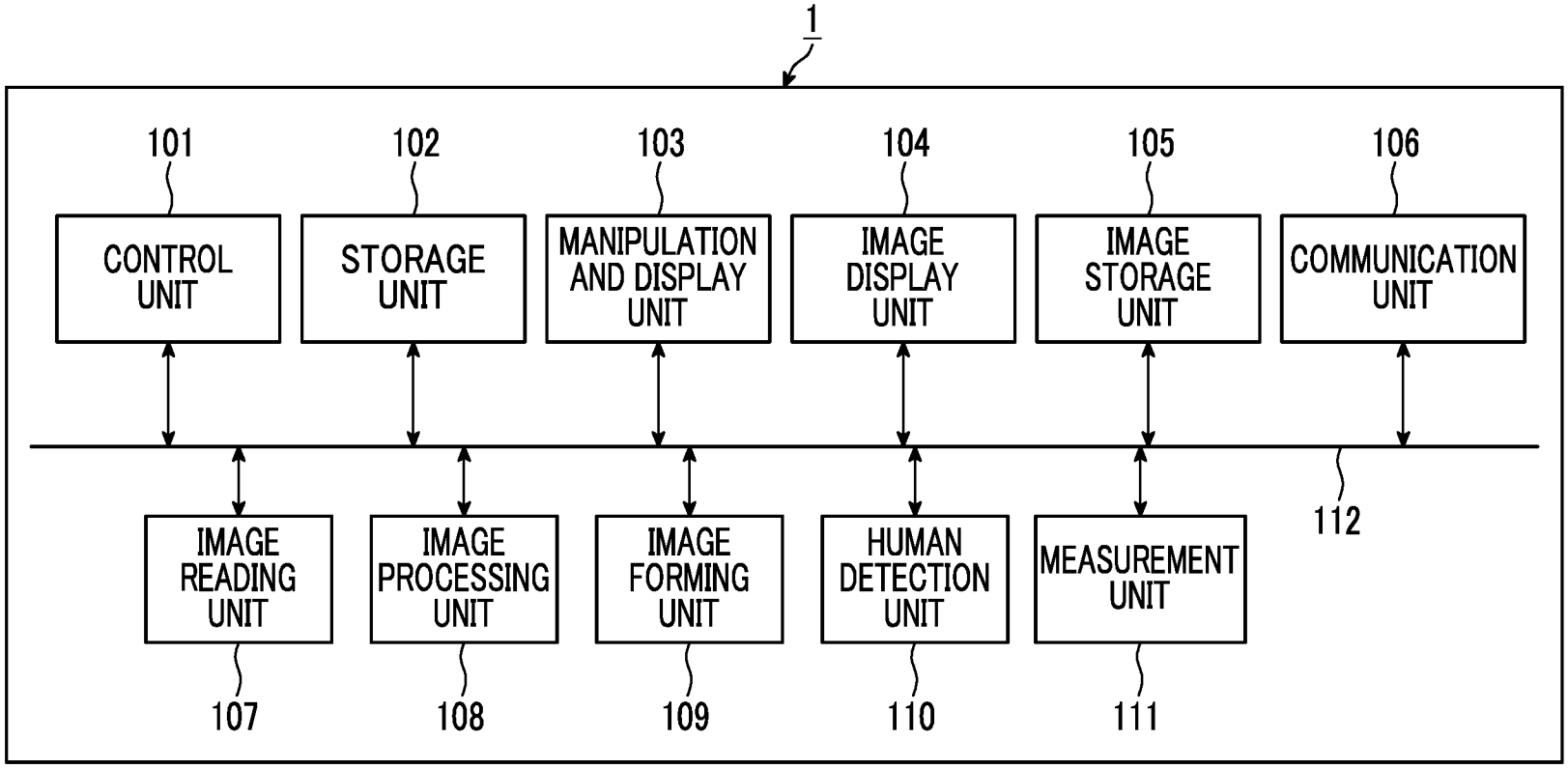
FIG. 7 is a block diagram illustrating a control apparatus of the image forming apparatus according to the first exemplary embodiment of the invention.

FIG. 7 is a block diagram illustrating a control apparatus of the image forming apparatus 1 to which the image display apparatus according to the first exemplary embodiment is applied. The image forming apparatus 1 includes the control unit 101, a storage unit 102, a manipulation and display unit 103, an image display unit 104 as an example of the image display apparatus, an image storage unit 105, a communication unit 106, an image reading unit 107, an image processing unit 108, an image forming unit 109, a human detection unit 110, and a measurement unit 111. The control unit 101 and the respective units 102 to 111 are connected to each other through a bus 112.

The control unit 101, which functions as the change section that changes the image displayed on the display panel 20, includes a not-shown Central Processing Unit (CPU) which comprehensively controls an operation of the image forming apparatus 1, a Read Only Memory (ROM), a Random Access Memory (RAM), and the like, and controls the respective units of the image forming apparatus 1 by executing a program stored in the storage unit 102. The control unit 101 performs a role as a computer which executes the program stored in the storage unit 102.

The storage unit 102 includes a hard disk, various ROMS or RAMS, or the like, and stores a program, which functions as the change section used by the control unit 101, or various programs and data.

Figure 8:
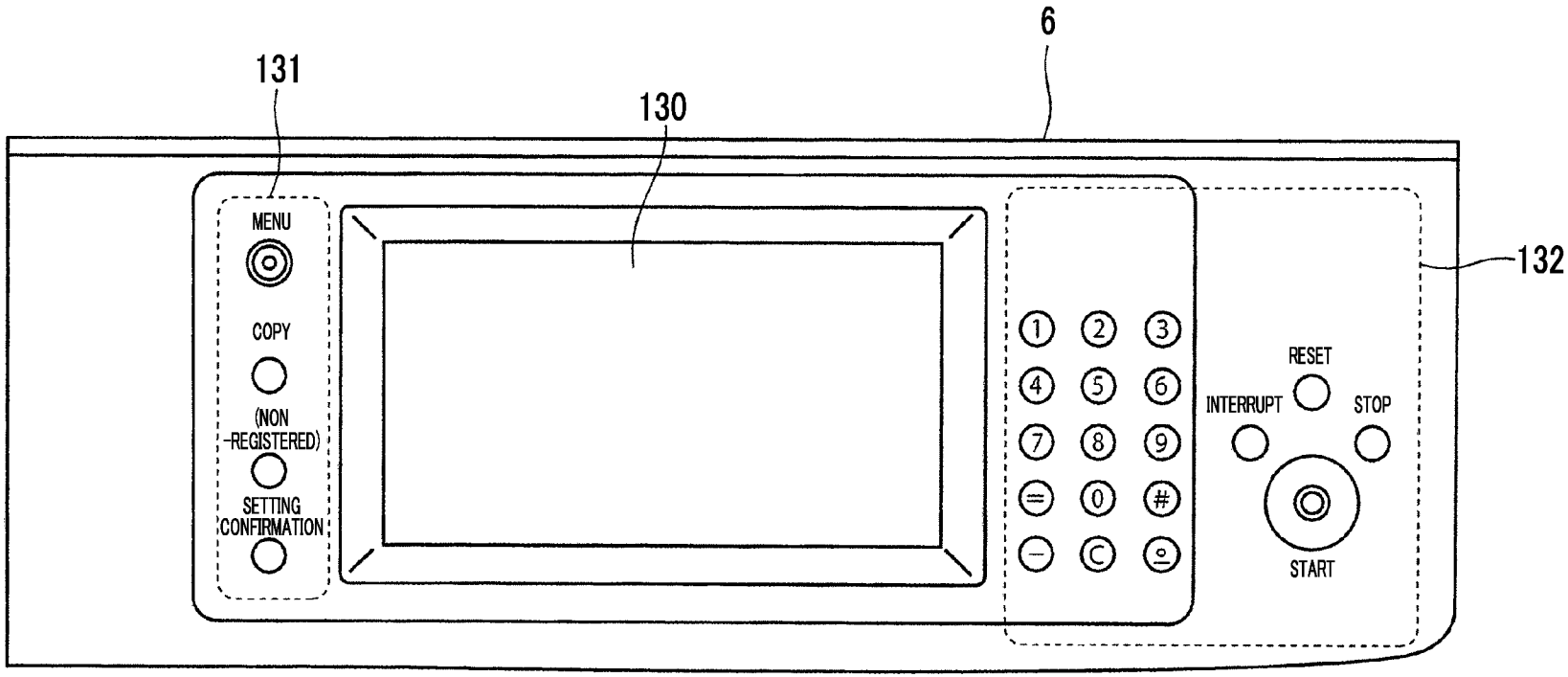
FIG. 8 is a configuration diagram illustrating a manipulation panel of the image forming apparatus according to the first exemplary embodiment of the invention.

The manipulation and display unit 103 inputs information to the control unit 101 according to a manipulation performed by the user U, and displays various pieces of information with respect to the user U. The manipulation and display unit 103 includes a touch panel 130, a first manipulation button group 131, and a second manipulation button group 132, which are provided on the manipulation panel 6 of the image forming apparatus 1, as illustrated in FIG. 8.

The image display unit 104 includes the display panel 20, and has a function of displaying various images on the display panel 20. The images displayed on the display panel 20 are selected and set up according to, for example, a signal or the like which is input from an external client apparatus through the communication unit 106.

The image storage unit 105 stores image data which includes image data of the image 21 displayed on the display panel 20. The image data stored in the image storage unit 105 may be stored in advance, or may be received from the outside through the communication unit 106 and be stored in the image storage unit 105.

The communication unit 106 is a communication interface which is connected to a not-shown communication line. The communication unit 106 performs communication with a client apparatus or another image forming apparatus (both are not shown in the drawing), a mobile terminal, such as a mobile phone of the user, or the like through the communication line. The communication unit 106 includes a case where communication is performed with the mobile terminal, such as the mobile phone, using the infrared light, Bluetooth, or the like, and a case where designated image information is transmitted to the mobile terminal as an electronic mail.

The image reading unit 107 generates the image data by reading the image of the document. In the exemplary embodiment, the image reading unit 107 includes the image reading device 5.

The image processing unit 108 performs various types of image processing, such as predetermined image processing, enlargement or reduction processing according to an intended magnification, consecutive enlargement or reduction processing, selection of the image, and change in the location, on the image of the document, which is read by the image reading unit 107, the image stored in the image storage unit 105, or the like.

The image forming unit 109 as an example of the image forming section, forms an image according to the image data on the recording medium such as the recording sheet. The image forming unit 109 is disposed on an inside of the apparatus main body 1*a* of the image forming apparatus 1, and forms the image in the electro-photographic method. It is apparent that the image forming unit 109 may form the image using another method.

In the image forming apparatus 1, image reading processing, copy processing, print processing, and facsimile transmission and reception processing are performed. The image reading processing is processing for generating the image data by reading the image of the document by the image reading device 5. The copy processing is processing for generating the image data by reading the image of the document by the image reading device 5, and forming the image on the recording medium based on the image data. The copy processing is performed by the image reading unit 107 and the image forming unit 109. The print processing is processing for forming the image on the recording medium based on the image data received from the client apparatus provided on the outside. The print processing is performed by the communication unit 106 and the image forming unit 109. In addition, the print processing includes an operation of printing the image based on the image data stored in the image storage unit 105.

The facsimile transmission processing is processing for generating the image data by reading the image of the document by the image reading device 5, and transmitting the generated image data to the facsimile apparatus through the communication unit 106. The facsimile transmission processing is performed by the image reading unit 107 and the communication unit 106. The facsimile reception processing is processing for forming the image on the recording medium based on the image data received from the facsimile apparatus. The facsimile reception processing is performed by the communication unit 106 and the image forming unit 109.

The human detection unit 110 detects a person (user) who exists in the vicinity of the apparatus main body 1*a* of the image forming apparatus 1. The human detection unit 110 includes the human detection sensor 30 having the first camera 31, the second camera 32, and the like.

In the first exemplary embodiment, basically, one singular user U is assumed as the user U who exists in the vicinity of the image forming apparatus 1. However, it is apparent that a plurality of users U may exist. In a case where the plurality of users U exist, the plurality of users U detected by the human detection unit 110 are identified by respectively giving IDs, such as U1 and U2 (not shown), for convenience.

The measurement unit 111 measures the distance L from the apparatus main body 1*a* of the image forming apparatus 1 to the user U according to the location of the user U detected by the human detection unit 110.

Operation of Image Forming Apparatus

In the image forming apparatus 1, to which the image display apparatus according to the first exemplary embodiment is applied, the image displayed on the display panel 20 is changed according to the location of the user U, compared to a case where an identical image is displayed on the display panel 20 regardless of the location of the user U, as below.

Figure 9:
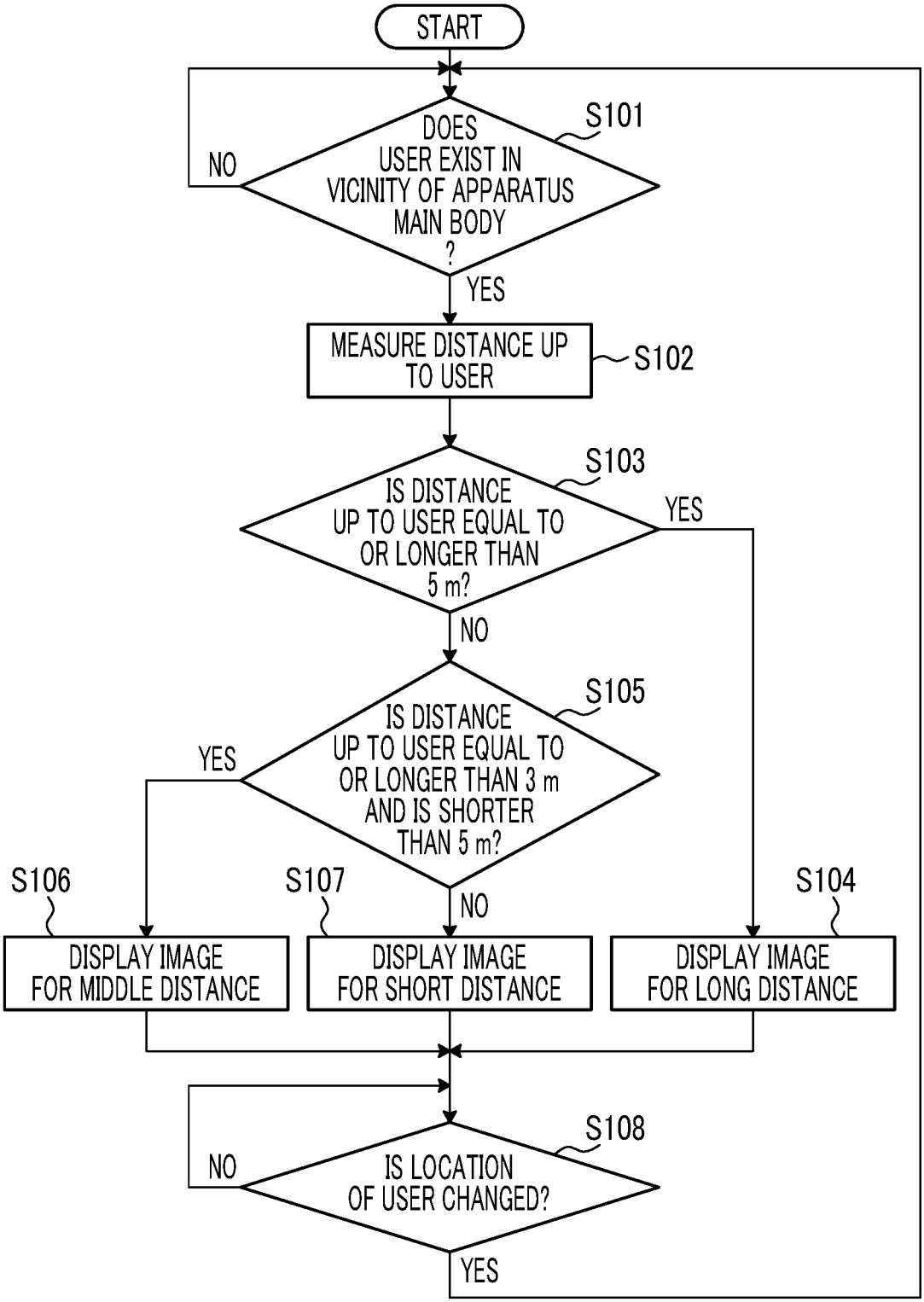
FIG. 9 is a flowchart illustrating a control operation of the image forming apparatus according to the first exemplary embodiment of the invention.

That is, in the image forming apparatus 1, to which the image display apparatus according to the first exemplary embodiment is applied, whether or not the user U exists in the vicinity of the apparatus main body 1*a* of the image forming apparatus 1 is determined by the control unit 101, as illustrated in FIG. 2A and FIG. 9, (Step S101). The control unit 101 determines whether or not the user U exists in the vicinity of the apparatus main body 1*a* of the image forming apparatus 1 based on the signal which is input from the human detection unit 110.

In a case where the control unit 101 determines that the user U does not exist in the vicinity of the apparatus main body 1*a* of the image forming apparatus 1, an operation of detecting the user U is continued until the user U moves in the vicinity of the apparatus main body 1*a* of the image forming apparatus 1, the user is detected by the human detection unit 110, and it is determined that user U exists in the vicinity of the apparatus main body 1*a* of the image forming apparatus 1. Meanwhile, the control unit 101 executes an operation of determining whether or not the user U exists in the vicinity of the apparatus main body 1*a* of the image forming apparatus 1 for each predetermined time.

In contrast, in a case where the control unit 101 determines that the user U exists in the vicinity of the apparatus main body 1*a* of the image forming apparatus 1, the control unit 101 measures the distance L from the apparatus main body 1*a* of the image forming apparatus 1 to the user U (Step S102). The distance L from the apparatus main body 1*a* to the user is measured by the measurement unit 111. Subsequently, in a case where the control unit 101 measures the distance L from the apparatus main body 1*a* of the image forming apparatus 1 to the user U, the control unit 101 determines whether or not the distance L is equal to or longer than 5 m (Step S103).

Figure 10A:
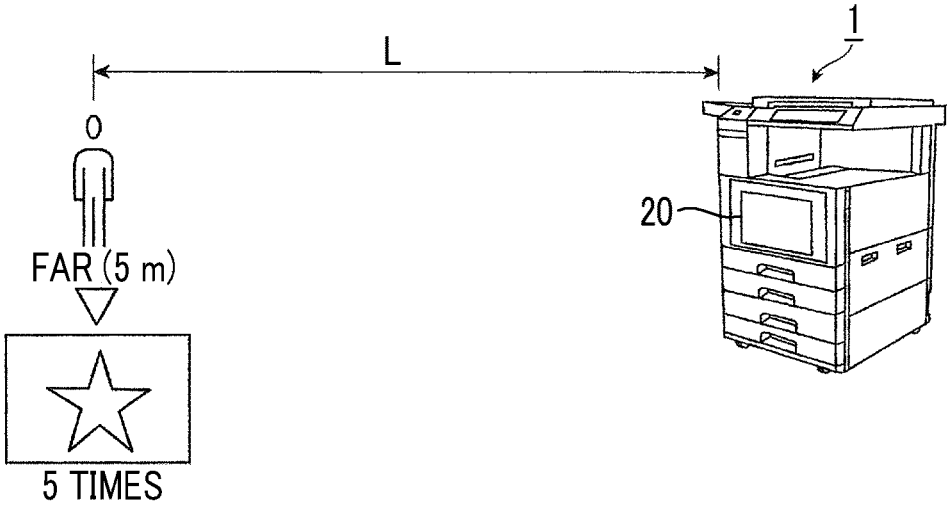
FIGS. 10A to 10C are perspective configuration diagrams illustrating a change in the image displayed on the display panel with regard to the image forming apparatus according to the first exemplary embodiment of the invention and a location of the user.
Figure 10B:
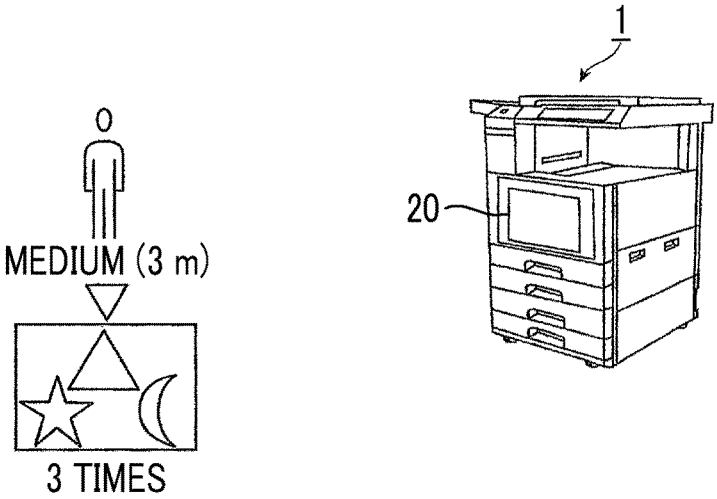
Figure 10C:
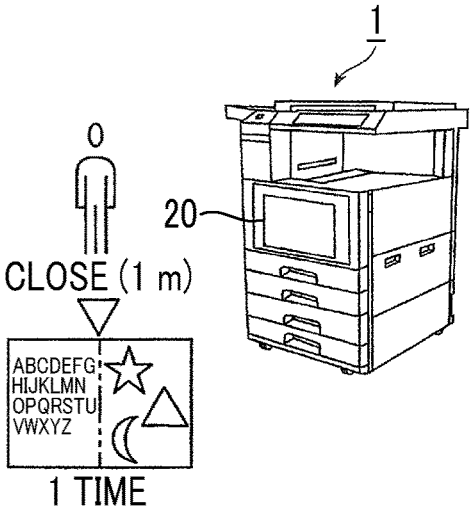

In a case where the control unit 101 determines that the distance L from the apparatus main body 1*a* of the image forming apparatus 1 to the user U is equal to or longer than 5 m, the control unit 101 displays, as the image 21 displayed on the display panel 20, an image 21 for a long distance, which corresponds to a case where the distance from the apparatus main body 1*a* of the image forming apparatus 1 to the user U is equal to or longer than 5 m, in the image to be originally displayed, on the display panel 20, as illustrated in FIG. 10A (Step S104). Here, the image 21 for the long distance is acquired by enlarging only the partial picture image 22*a* (for example, 5 times) in the whole image 21 to be originally displayed and displaying the enlarged picture image 22*a* on a whole surface of the display panel 20, as illustrated in FIG. 4A. The image 21 for the long distance is stored, for example, in the image storage unit 105 in advance.

However, the image for the long distance in the image to be originally displayed is not limited to a case of being stored in the image storage unit 105 in advance. Only data of the whole image 21 to be originally displayed, illustrated in FIG. 4C, is stored in the image storage unit 105 in advance, and the image for the long distance may be generated at each time by performing the enlargement processing, the selection processing, or the like on a necessary part from the whole image 21 to be originally displayed using the image processing unit 108.

In addition, as illustrated in FIG. 9, in a case where the control unit 101 determines that the distance L from the apparatus main body 1*a* of the image forming apparatus 1 to the user U is not equal to or longer than 5 m, the control unit 101 determines whether or not the distance L from the apparatus main body 1*a* of the image forming apparatus 1 to the user U is equal to or longer than 3 m and is shorter than 5 m (Step S105).

In a case where the control unit 101 determines that the distance from the apparatus main body 1*a* of the image forming apparatus 1 to the user U is equal to or longer than 3 m and is shorter than 5 m, the control unit 101 displays, as the image 21 displayed on the display panel 20, the images 22*a*, 22*b*, and 22*c* for a middle distance, which are apposite to a case where the distance L from the apparatus main body 1*a* of the image forming apparatus 1 to the user U is equal to or longer than 3 m and is shorter than 5 m, in the image to be originally displayed, on the display panel 20 (Step S106). Here, the images 22*a*, 22*b*, and 22*c* for the middle distance are images which are shown by enlarging only a part of the picture image 22 in the whole image 21, as illustrated in FIG. 4B. For example, the image for the middle distance is either stored in the image storage unit 105 in advance or generated at each time.

In contrast, in a case where the control unit 101 determines that the distance from the apparatus main body 1*a* of the image forming apparatus 1 to the user U is not equal to or longer than 3 m and is shorter than 5 m, the control unit 101 displays, as the image 21 displayed on the display panel 20, an image for a short distance, in a case where the distance L from the apparatus main body 1*a* of the image forming apparatus 1 to the user U is shorter than 3 m, in the image to be originally displayed, on the display panel 20 (Step S107). Here, an image for the short distance 21 is the whole image 21 which includes both the picture image 22 to be originally displayed and the text image 23, as illustrated in FIG. 4C. The image for the short distance is stored, for example, in the image storage unit 105 in advance.

Thereafter, the control unit 101 determines whether or not the location of the user U is changed (Step S108). In a case where the control unit 101 determines that the location of the user U is not changed, the control unit 101 continues determination of the change in the location of the user U until the control unit 101 detects that the location of the user U is changed.

Here, a case where the location of the user U is changed includes a case where the location of the user U is changed even a little.

In contrast, in a case where the control unit 101 determines that the location of the user U is changed, the process returns to Step S101, and the control unit 101 determines again whether or not the user U exists in the vicinity of the apparatus main body 1*a* of the image forming apparatus 1. In a case where the control unit 101 determines that the user U exists in the vicinity of the apparatus main body 1*a* of the image forming apparatus 1, the control unit 101 measures the distance L again from the apparatus main body 1*a* of the image forming apparatus 1 to the user U (Step S102).

In a case where the control unit 101 measures the distance L again from the apparatus main body 1*a* of the image forming apparatus 1 to the user U, the control unit 101 determines whether or not the distance L is equal to or longer than 5 m (Step S103).

Further, in a case where the control unit 101 determines that the distance from the apparatus main body 1*a* of the image forming apparatus 1 to the user is equal to or longer than 5 m, the control unit 101 displays, as the image displayed on the display panel 20, the image 21 for the long distance, which is apposite to a case where the distance from the apparatus main body 1*a* of the image forming apparatus 1 to the user is equal to or longer than 5 m, in a random image, on the display panel 20 (Step S104).

In addition, in a case where the control unit 101 determines that the distance from the apparatus main body 1*a* of the image forming apparatus 1 to the user U is not equal to or longer than 5 m, the control unit 101 determines whether or not the distance from the apparatus main body 1*a* of the image forming apparatus 1 to the user U is equal to or longer than 3 m and is shorter than 5 m (Step S105).

In a case where the control unit 101 determines that the distance from the apparatus main body 1*a* of the image forming apparatus 1 to the user U is equal to or longer than 3 m and is shorter than 5 m, the control unit 101 displays, as the image 21 displayed on the display panel 20, the image for the middle distance illustrated in FIG. 4B, on the display panel 20 (Step S106).

Further, in a case where the control unit 101 determines that the distance from the apparatus main body 1*a* of the image forming apparatus 1 to the user U is not equal to or longer than 3 m and is shorter than 5 m, the control unit 101 displays, as the image 21 displayed on the display panel 20, the image for the short distance 21 on the display panel 20 (Step S107).

Thereafter, the control unit 101 determines whether or not the location of the user U is changed (Step S108), and repeatedly executes the same operation.

As described above, according to the image forming apparatus 1, to which the image display apparatus according to the first exemplary embodiment is applied, it is possible to change the image 21 displayed on the display panel 20 according to the location of the user U, compared to the case where the identical image is displayed on the display panel 20 regardless of the location of the user U.

Therefore, in a case where the user U exists at a long distance, which is separated to be equal to or longer than 5 m, from the apparatus main body 1*a* of the image forming apparatus 1, the image 21 for the long distance is displayed on the display panel 20, and thus it is possible for the user to visually observe the image 21, displayed on the display panel 20, easily according to the location of the user U. In addition, in a case where the user U exists at a short distance, which is shorter than 3 m, from the apparatus main body 1*a* of the image forming apparatus 1, the image for the short distance 21 is displayed on the display panel 20, and thus it is easy for the user U to visually observe a large number of pieces of image information from the image for the short distance 21, which is displayed on the display panel 20, according to the location of the user U.

Second Exemplary Embodiment

Figure 11:
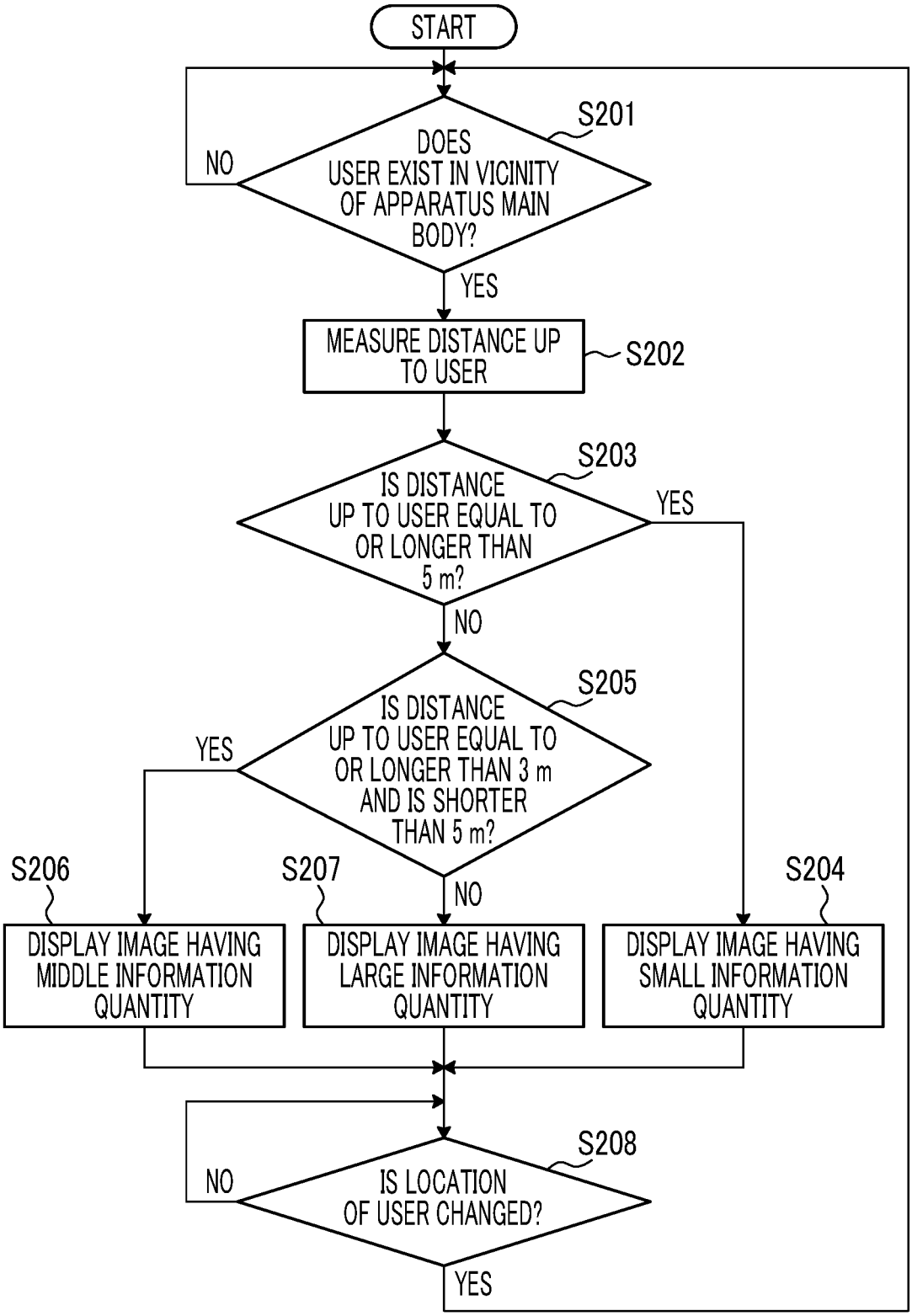
FIG. 11 is a flowchart illustrating a control operation of an image forming apparatus according to a second exemplary embodiment of the invention.

FIG. 11 illustrates an operation of an image forming apparatus to which an image display apparatus according to a second exemplary embodiment is applied. In the second exemplary embodiment, the change section is configured to change an information quantity of the image displayed on the display section according to a result of detection performed by the detection section. In addition, the change section is configured to increase the information quantity of the image displayed on the display section as the location of the user, which is detected by the detection section, approaches the apparatus main body.

That is, an image forming apparatus 1, to which the image display apparatus according to the second exemplary embodiment is applied, determines whether or not the user U exists in the vicinity of the apparatus main body 1*a* of the image forming apparatus 1 using the control unit 101, as illustrated in FIG. 2A and FIG. 11, (Step S201). The control unit 101 determines whether or not the user U exists in the vicinity of the apparatus main body 1*a* of the image forming apparatus 1 based on the signal which is input from the human detection unit 110.

In a case where the control unit 101 determines that the user U does not exist in the vicinity of the apparatus main body 1*a* of the image forming apparatus 1, an operation of detecting the user U is continued until the user U moves in the vicinity of the apparatus main body 1*a* of the image forming apparatus 1, the user is detected by the human detection unit 110, and it is determined that user U exists in the vicinity of the apparatus main body 1*a* of the image forming apparatus 1. Meanwhile, the control unit 101 executes an operation of determining whether or not the user U exists in the vicinity of the apparatus main body 1*a* of the image forming apparatus 1 for each predetermined time.

In contrast, in a case where the control unit 101 determines that the user U exists in the vicinity of the apparatus main body 1*a* of the image forming apparatus 1, the control unit 101 measures the distance from the apparatus main body 1*a* of the image forming apparatus 1 to the user L (Step S202). The distance L from the apparatus main body 1*a* to the user is measured by the measurement unit 111. Subsequently, in a case where the control unit 101 measures the distance L from the apparatus main body 1*a* of the image forming apparatus 1 to the user U, the control unit 101 determines whether or not the distance L is equal to or longer than 5 m (Step S203).

Figure 12A:
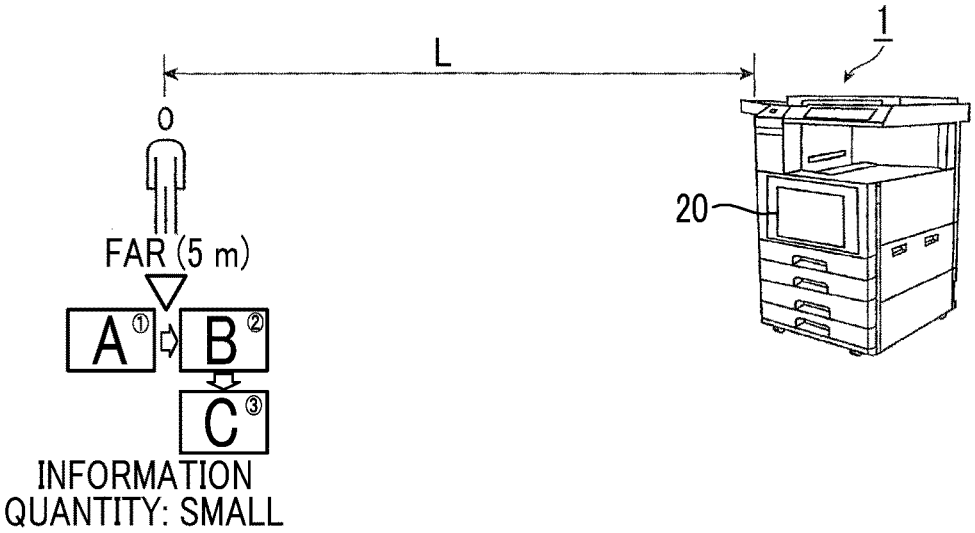
FIGS. 12A to 12C are perspective configuration diagrams illustrating a change in an image displayed on the display panel with regard to the image forming apparatus according to the second exemplary embodiment of the invention and a location of the user.
Figure 12B:
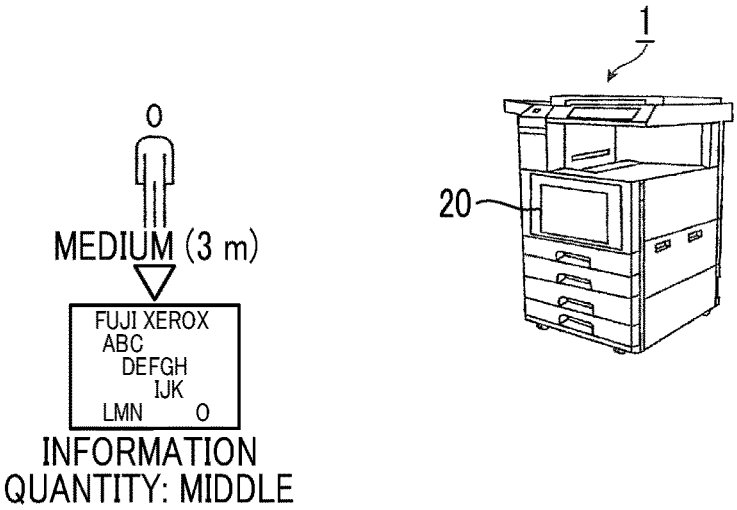
Figure 12C:
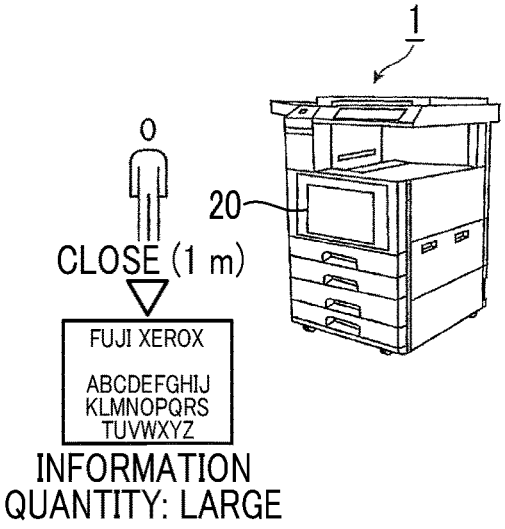
Figure 13A:
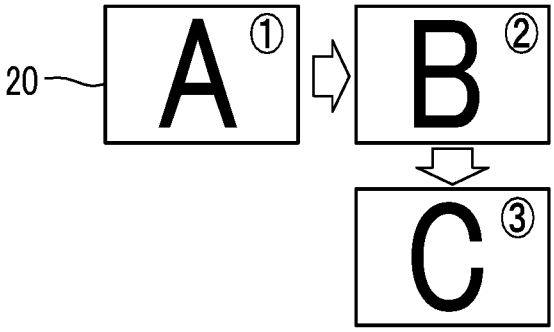
FIGS. 13A to 13C are schematic configuration diagrams illustrating the image displayed on the display panel.

In a case where the control unit 101 determines that the distance L from the apparatus main body 1*a* of the image forming apparatus 1 to the user U is equal to or longer than 5 m, the control unit 101 displays, as the image 21 displayed on the display panel 20, an image 21 which has a small information quantity in the case where the distance L from the apparatus main body 1*a* of the image forming apparatus 1 to the user U is equal to or longer than 5 m, in the image to be originally displayed, on the display panel 20, as illustrated in FIG. 12A (Step S204). Here, as illustrated in FIG. 13A, the image 21 which has the small information quantity is provided in such a way that only a part of the text image 23 is enlarged (for example, 5 times), of the whole image 21 to be originally displayed, and each one text is sequentially displayed on the whole surface of the display panel 20 in a slide format. The image 21 which has the small information quantity is stored, for example, in the image storage unit 105 in advance.

However, the image 21 which has the small information quantity in the image to be originally displayed is not limited to the case of being stored in the image storage unit 105 in advance, and the image 21 which has the small information quantity may be generated at each time by performing a necessary enlargement processing or the like in the image processing unit 108 on the image to be originally displayed.

In addition, in a case where the control unit 101 determines that the distance L from the apparatus main body 1*a* of the image forming apparatus 1 to the user U is not equal to or longer than 5 m, as illustrated in FIG. 11, the control unit 101 determines whether or not the distance L from the apparatus main body 1*a* of the image forming apparatus 1 to the user U is equal to or longer than 3 m and is shorter than 5 m (Step S205).

Figure 13B:
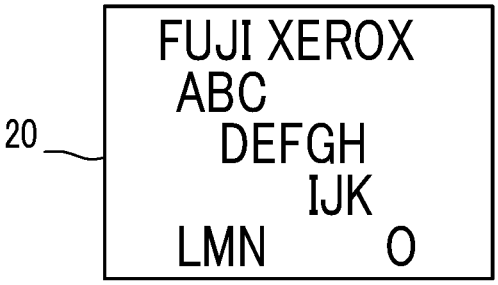

In a case where the control unit 101 determines that the distance from the apparatus main body 1*a* of the image forming apparatus 1 to the user U is equal to or longer than 3 m and is shorter than 5 m, the control unit 101 displays, as the image 21 displayed on the display panel 20, a text image 23, which has a medium-information quantity and which is apposite to a case where the distance L from the apparatus main body 1*a* of the image forming apparatus 1 to the user U is equal to or longer than 3 m and is shorter than 5 m, in the image to be originally displayed, on the display panel 20 (Step S206). Here, the text image 23, which has the medium-information quantity, is an image which is shown by enlarging a part of the text image 23 in the whole image, as illustrated in FIG. 13B. The text image 23, which has medium-information quantity, is stored, for example, in the image storage unit 105 in advance.

Figure 13C:
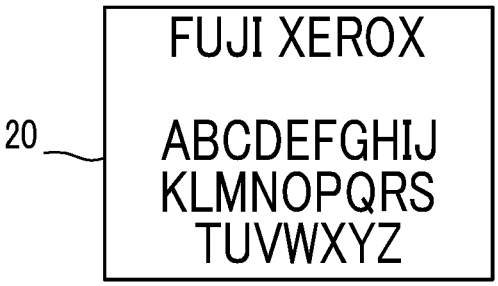

Further, in a case where the control unit 101 determines that the distance from the apparatus main body 1*a* of the image forming apparatus 1 to the user U is not equal to or longer than 3 m and is shorter than 5 m, the control unit 101 displays, as the image displayed on the display panel 20, the whole image to be originally displayed, that is, the text image 23 which has the largest information quantity, in a case where the distance L from the apparatus main body 1*a* of the image forming apparatus 1 to the user U is shorter than 3 m, on the display panel 20 (Step S207). Here, the text image 23 which has the largest information quantity is the whole image to be originally displayed, as illustrated in FIG. 13C. The text image 23 which has the largest information quantity is stored in, for example, the image storage unit 105 in advance.

Thereafter, the control unit 101 determines whether or not the location of the user U is changed (Step S208). In a case where the control unit 101 determines that the location of the user U is not changed, the control unit 101 continues determination of the change in the location of the user U until a fact that the location of the user U is changed is detected.

In contrast, in a case where the control unit 101 determines that the location of the user U is changed, the process returns to Step S201, and the control unit 101 determines whether or not the user U exists in the vicinity of the apparatus main body 1*a* of the image forming apparatus 1. In a case where the control unit 101 determines that the user U exists in the vicinity of the apparatus main body 1*a* of the image forming apparatus 1, the control unit 101 measures the distance L again from the apparatus main body 1*a* of the image forming apparatus 1 to the user U (Step S202).

In a case where the control unit 101 measures the distance L again from the apparatus main body 1*a* of the image forming apparatus 1 to the user U, the control unit 101 determines whether or not the distance L is equal to or longer than 5 m (Step S203).

Further, in a case where the control unit 101 determines that the distance from the apparatus main body 1*a* of the image forming apparatus 1 to the user is equal to or longer than 5 m, the control unit 101 displays, as the image displayed on the display panel 20, the image 21 which has the small information quantity in a case where the distance from the apparatus main body of the image forming apparatus to the user is equal to or longer than 5 m, in the random image, on the display panel 20 (Step S204).

In addition, in a case where the control unit 101 determines that the distance L from the apparatus main body 1*a* of the image forming apparatus 1 to the user U is not equal to or longer than 5 m, the control unit 101 determines whether or not the distance L from the apparatus main body 1*a* of the image forming apparatus 1 to the user U is equal to or longer than 3 m and is shorter than 5 m (Step S205).

In a case where the control unit 101 determines that the distance from the apparatus main body 1*a* of the image forming apparatus 1 to the user U is equal to or longer than 3 m and is shorter than 5 m, the control unit 101 displays, as the image 21 displayed on the display panel 20, the text image 23 which has the medium-information quantity, on the display panel 20, as illustrated in FIG. 13B, (Step S206).

Further, in a case where the control unit 101 determines that the distance from the apparatus main body 1*a* of the image forming apparatus 1 to the user U is not equal to or longer than 3 m and is shorter than 5 m, the control unit 101 displays, as the image 21 displayed on the display panel 20, the whole image to be originally displayed, that is, the image which includes the text image 23 which has the largest information quantity, on the display panel 20, as FIG. 13C (Step S207).

Hereinafter, the control unit 101 determines whether or not the location of the user U is changed (Step S208), and repeatedly executes the same operation.

As above, according to the image forming apparatus 1, to which the image display apparatus according to the second exemplary embodiment is applied, it is possible to change the information quantity of the image 21 displayed on the display panel 20 according to the location of the user U, compared to the case where the identical image is displayed on the display panel 20 regardless of the location of the user U.

Therefore, in the case where the user U exists at the long distance, which is separated to be equal to or longer than 5 m from the apparatus main body 1*a* of the image forming apparatus 1, the text image 23 which has the small information quantity is displayed on the display panel 20 in the slide format, and thus it is possible for the user U to visually observe the image 21 displayed on the display panel 20 easily according to the location of the user U.

Therefore, in the case where the user U exists at the long distance, which is separated to be equal to or longer than 5 m from the apparatus main body 1*a* of the image forming apparatus 1, the image 21 which has the small information quantity is displayed on the display panel 20, and thus it is possible for the user U to visually observe the image 21, which has the small information quantity and which is displayed on the display panel 20 according to the location of the user U, easily. In addition, in a case where the user U exists at the short distance which is shorter than 3 m from the apparatus main body 1*a* of the image forming apparatus 1, the image 21 which has the largest information quantity is displayed on the display panel 20, and thus it is possible for the user U to easily acquire a large quantity of image information from the image 21 which has the largest information quantity and which is displayed on the display panel 20 according to the location of the user U.

Since other configurations and actions are the same as in the exemplary embodiment, the description thereof will not be repeated.

Third Exemplary Embodiment

Figure 14:
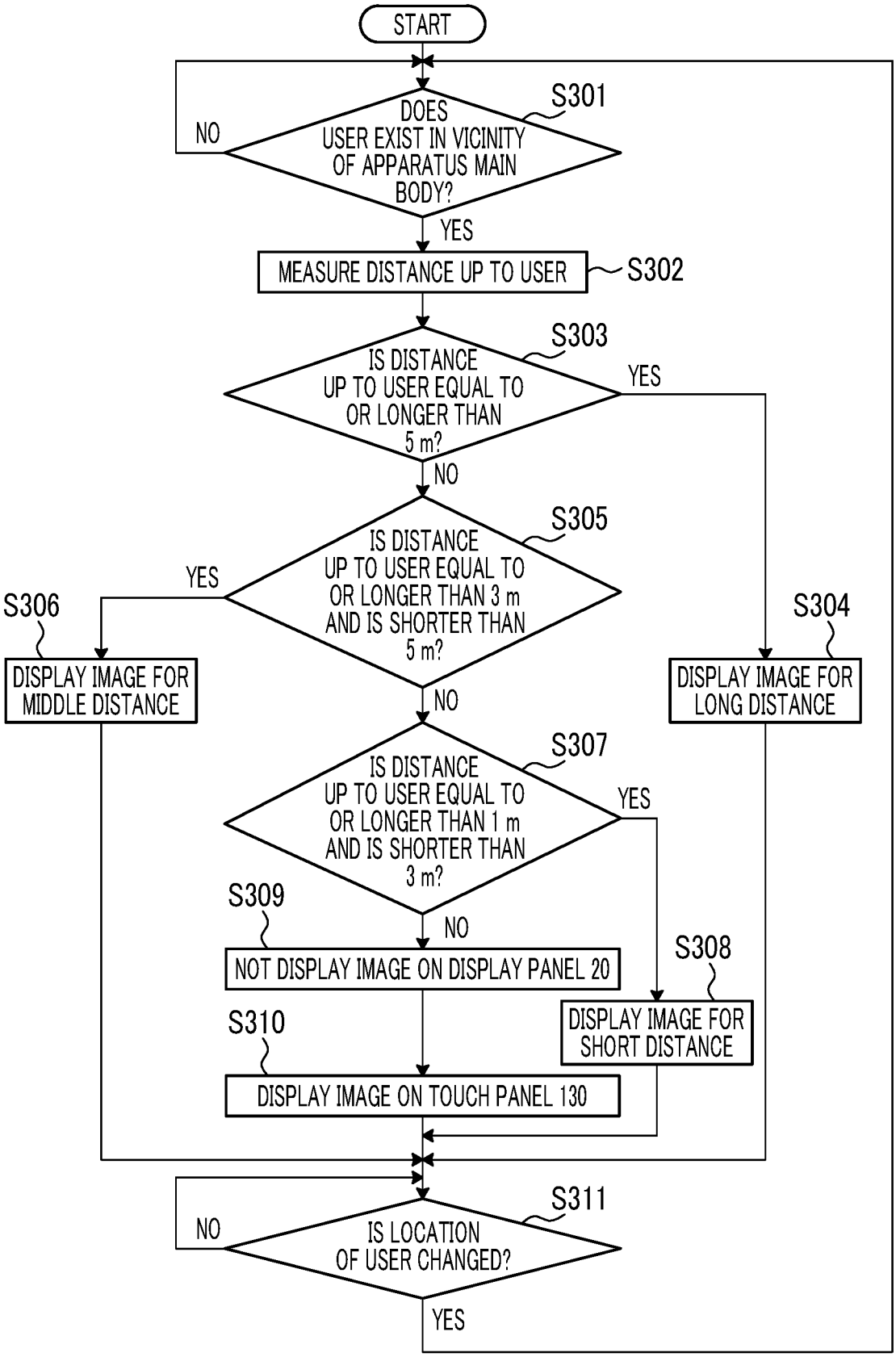
FIG. 14 is a flowchart illustrating a control operation of an image forming apparatus according to a third exemplary embodiment of the invention.

FIG. 14 illustrates an operation of an image forming apparatus to which an image display apparatus according to a third exemplary embodiment is applied. In the third exemplary embodiment, a second display section is included which is different from the display section, and an image of an identical attribute to the image displayed on the display section is displayed on the second display section.

In addition, the third exemplary embodiment is configured to increase the information quantity of the image displayed on the second display section with respect to the image for the second location.

Further, in a case where the image is displayed on the second display section, the display section is configured to not display the image.

That is, the third exemplary embodiment includes the touch panel 130 as an example of the second display section on the manipulation panel 6, as illustrated in FIG. 8. The touch panel 130 includes a liquid crystal panel as the example of the second display section which displays the image, and a touch location detection panel for detecting a touch location touched by the user.

The control unit 101 controls the touch panel 130 of the manipulation panel 6 as the second display section of the image display apparatus.

That is, in the image forming apparatus 1 according to the third exemplary embodiment, the control unit 101 determines whether or not the user U exists in the vicinity of the apparatus main body 1*a* of the image forming apparatus 1, as illustrated in FIG. 14, (Step S301). The control unit 101 determines whether or not the user U exists in the vicinity of the apparatus main body 1*a* of the image forming apparatus 1 based on the signal which is input from the human detection unit 110.

In a case where the control unit 101 determines that the user U does not exist in the vicinity of the apparatus main body 1*a* of the image forming apparatus 1, the control unit 101 continues detection of the user U until the user who exists in the vicinity of the apparatus main body 1*a* of the image forming apparatus 1 is detected by the human detection unit 110 and it is determined that the user U exists. Meanwhile, the control unit 101 executes an operation of determining whether or not the user U exists in the vicinity of the apparatus main body 1*a* of the image forming apparatus 1 for each predetermined time.

In contrast, in a case where the control unit 101 determines that the user U exists in the vicinity of the apparatus main body 1*a* of the image forming apparatus 1, the control unit 101 measures the distance from the apparatus main body 1*a* of the image forming apparatus 1 to the user L (Step S302). The distance L from the apparatus main body 1*a* to the user U is measured by the measurement unit 111. Subsequently, in a case where the control unit 101 measures the distance L from the apparatus main body 1*a* of the image forming apparatus 1 to the user U, the control unit 101 determines whether or not the distance L is equal to or longer than 5 m (Step S303).

In a case where the control unit 101 determines that the distance from the apparatus main body 1*a* of the image forming apparatus 1 to the user U is equal to or longer than 5 m, the control unit 101 displays, as the image 21 displayed on the display panel 20, the image 21 for the long distance in a case where the distance from the apparatus main body 1*a* of the image forming apparatus 1 to the user U is equal to or longer than 5 m, in the image to be originally displayed, on the display panel 20, as illustrated in FIG. 10A (Step S304).

In addition, as illustrated in FIG. 14, in a case where the control unit 101 determines that the distance L from the apparatus main body 1*a* of the image forming apparatus 1 to the user U is not equal to or longer than 5 m, the control unit 101 determines whether or not the distance L from the apparatus main body 1*a* of the image forming apparatus 1 to the user U is equal to or longer than 3 m and is shorter than 5 m (Step S305).

In a case where the control unit 101 determines that the distance from the apparatus main body 1*a* of the image forming apparatus 1 to the user U is equal to or longer than 3 m and is shorter than 5 m, the control unit 101 displays, as the image 21 displayed on the display panel 20, an image 21 for the middle distance, which is apposite to a case where the distance L from the apparatus main body 1*a* of the image forming apparatus 1 to the user U is equal to or longer than 3 m and is shorter than 5 m, in the image to be originally displayed, on the display panel 20 (Step S306).

Further, in a case where the control unit 101 determines that the distance from the apparatus main body 1*a* of the image forming apparatus 1 to the user U is not equal to or longer than 3 m and is shorter than 5 m, the control unit 101 determines whether or not the distance from the apparatus main body 1*a* of the image forming apparatus 1 to the user U is equal to or longer than 1 m and is shorter than 3 m (Step S307).

In a case where the control unit 101 determines that the distance from the apparatus main body 1*a* of the image forming apparatus 1 to the user U is equal to or longer than 1 m and is shorter than 3 m, the control unit 101 displays, as the image 21 displayed on the display panel 20, the image for the short distance 21 which is suitable to a case where the distance L from the apparatus main body 1*a* of the image forming apparatus 1 to the user U is equal to or longer than 1 m and is shorter than 3 m, on the display panel 20 (Step S308).

In contrast, in a case where the control unit 101 determines that the distance from the apparatus main body 1*a* of the image forming apparatus 1 to the user U is equal to or longer than 1 m and is shorter than 3 m, the control unit 101 does not display the image 21 on the display panel 20, and stops (suppresses) displaying the image 21 on the display panel 20 (Step S309). At this time, instead of a case where the control unit 101 determines that the distance from the apparatus main body 1*a* of the image forming apparatus 1 to the user U is not equal to or longer than 1 m and is shorter than 3 m, the control unit 101 is configured to not display the image 21 on the display panel 20 and to stop displaying the image 21 on the display panel 20 in a case where the user U manipulates the touch panel 130.

Figure 15A:
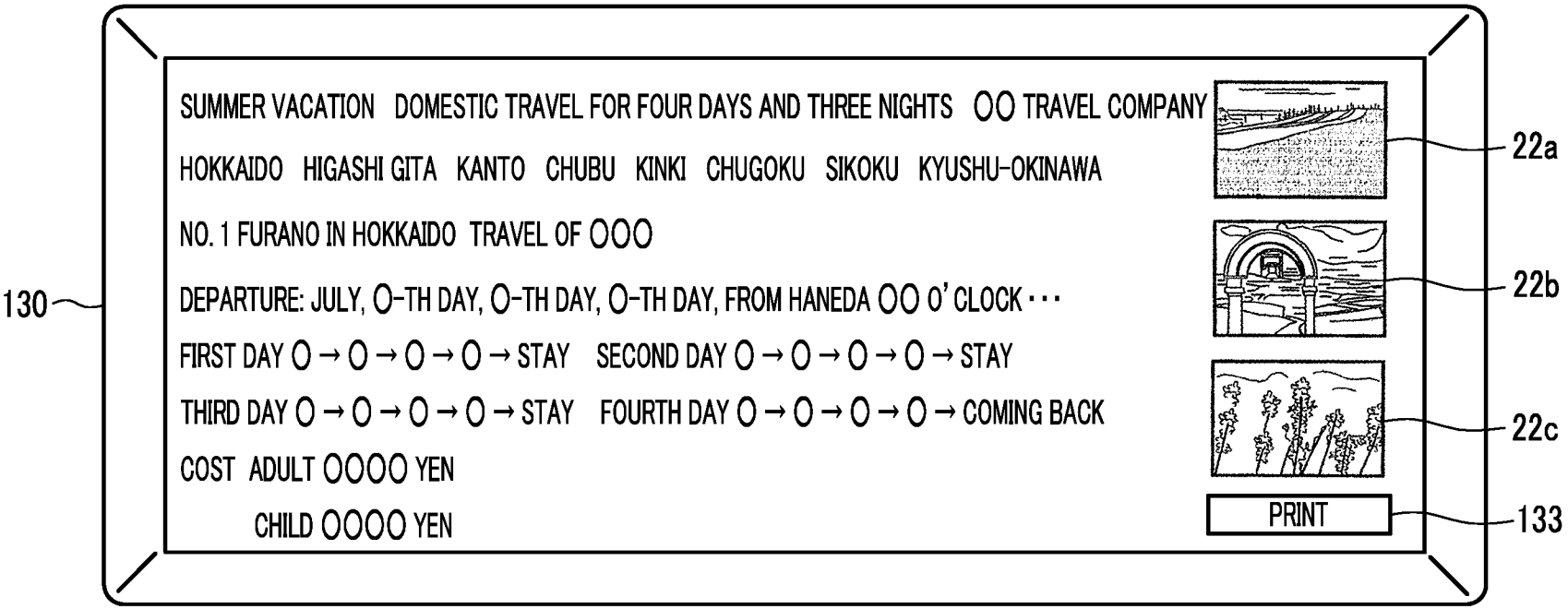
FIGS. 15A and 15B are configuration diagrams illustrating a touch panel of the image forming apparatus according to the third exemplary embodiment of the invention.
Figure 15B:
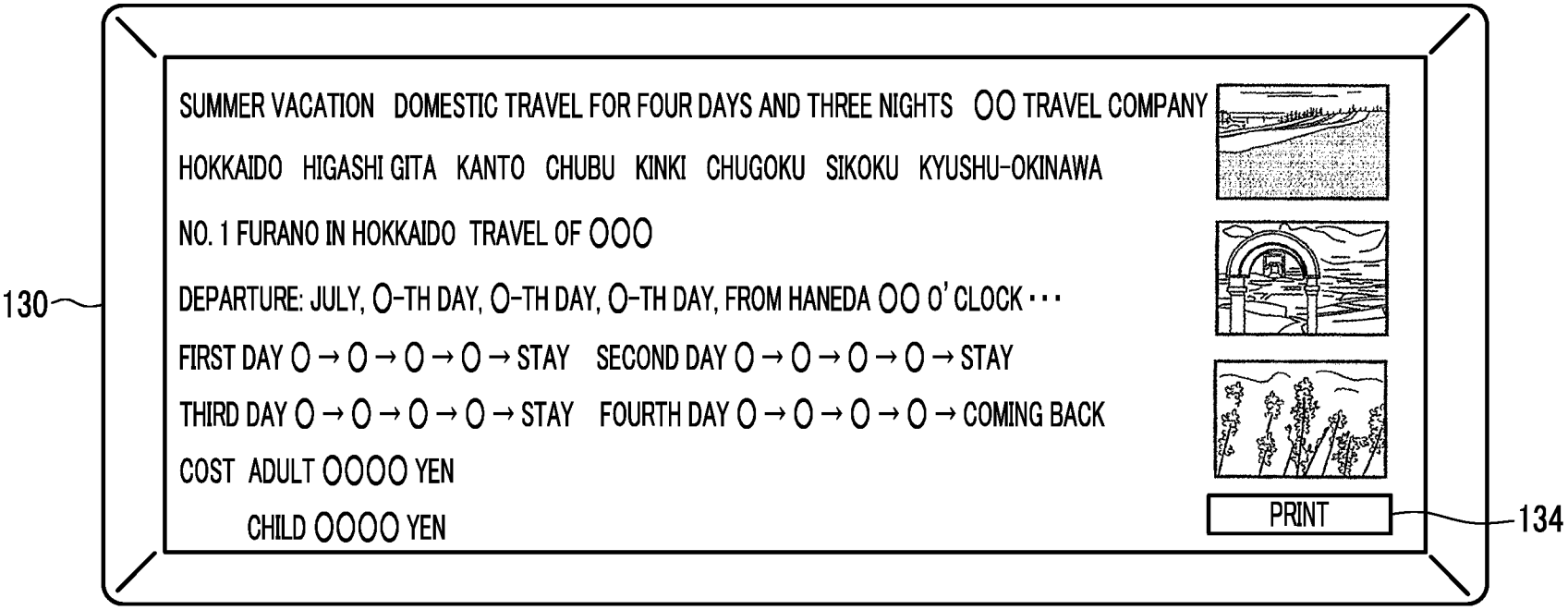

Thereafter, the control unit 101 displays a proximity image on the touch panel 130 of the manipulation panel 6 (Step S310). Here, the proximity image 21 is an image acquired by further increasing the information quantity in the image for the short distance, which includes the picture image 22 to be originally displayed and the text image 23, as illustrated in FIGS. 15A and 15B. The proximity image is stored, for example, in the image storage unit 105 in advance.

At this time, for example, it is preferable to configure the control unit 101 to display manipulation buttons 133 and 134, such as "print" and "send by mail", on the touch panel 130 of the manipulation panel 6, as illustrated in FIGS. 15A and 15B, and, in a case where the user U manipulates the manipulation buttons 133 and 134, such as "print" and "send by mail", to print the proximity image displayed on the touch panel 130 by operating the image forming unit 109 or to send the proximity image by mail to a smartphone or the like of the user U by operating the communication unit 106 through infrared light communication or the like. In a case where the user U does not desire to display the proximity image 21 on the touch panel 130 of the manipulation panel 6, an operation of copy or facsimile transmission and reception is possible by manipulating "menu" buttons or the like of the first manipulation button group 131 and the second manipulation button group 132 which are provided in the manipulation panel 6, as illustrated in FIG. 8.

Thereafter, the control unit 101 determines whether or not the location of the user U is changed (Step S311). In a case where the control unit 101 determines that the location of the user U is not changed, the control unit 101 continues determination of the change in the location of the user U until a fact that the location of the user U is changed is detected.

In contrast, in a case where the control unit 101 determines that the location of the user U is changed, the process returns to Step S301, and the same processing is repeated.

As above, according to the image forming apparatus 1, to which the image display apparatus according to the third exemplary embodiment is applied, in a case where the user U exists within 1 m from the apparatus main body 1*a* of the image forming apparatus 1, it is possible for the user U to visually observe the touch panel 130 provided in the manipulation panel 6 of the image forming apparatus 1. Therefore, in a case where the proximity image, which is acquired by further increasing the information quantity in the whole image, is displayed on the touch panel 130, it is possible to deliver a larger amount of information to the user U.

In addition, simultaneously, in a case where the touch panel 130 is manipulated in the image forming apparatus 1, it is possible to print the proximity image, and thus convenience is further improved.

Since other configurations and actions are the same as in the exemplary embodiment, the description thereof will not be repeated.

Fourth Exemplary Embodiment

FIGS. 16 to 19 illustrate an image forming apparatus to which an image display apparatus according to a fourth exemplary embodiment is applied. In the fourth exemplary embodiment, the detection section is configured to be capable of detecting a direction of a face of the user.

In addition, in the fourth exemplary embodiment, the change section is configured to enlarge and display an image displayed on the display section to correspond to the direction of the face of the user detected by the detection section.

Figure 16:
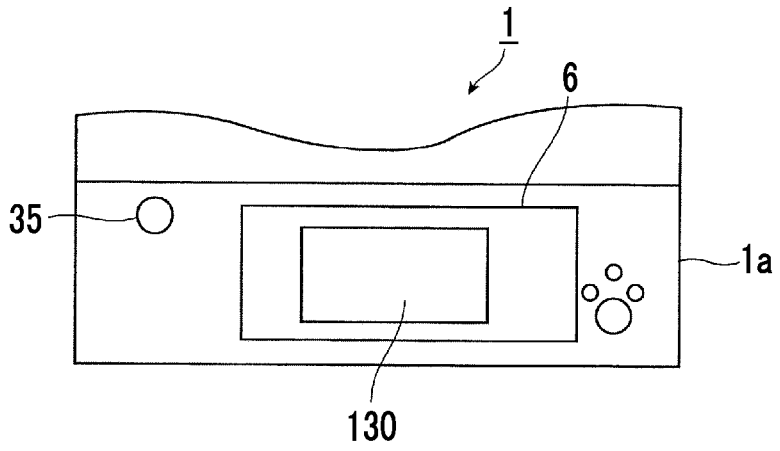
FIG. 16 is a configuration diagram illustrating a touch panel of an image forming apparatus according to a fourth exemplary embodiment of the invention.
Figure 17:
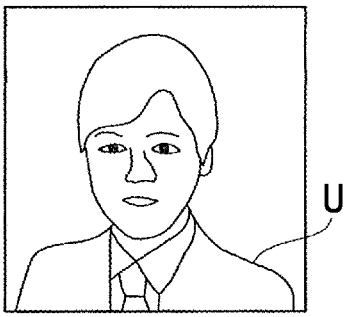
FIG. 17 is a schematic diagram illustrating a face of a user detected by a third camera.

That is, in the fourth exemplary embodiment, a third camera 35, which detects the face of the user, is provided in the manipulation panel 6, as illustrated in FIG. 16. In the third camera 35, the face of the user U who manipulates the apparatus main body 1*a* of the manipulation panel 6 of the image forming apparatus 1 is detected (photographed), as illustrated in FIG. 17.

Figure 18:
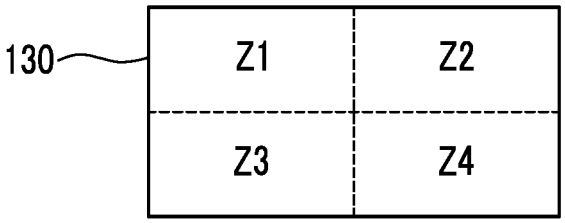
FIG. 18 is an explanatory diagram illustrating areas acquired by dividing an image displayed on a touch panel.

The control unit 101 determines whether or not the user U, who is detected using a detection signal from the third camera 35, visually recognizes an image displayed on the touch panel 130 of the manipulation panel 6 using the direction of the face of the user U, a direction of visual line, or the like. Simultaneously, in a case where the control unit 101 determines that the user U visually recognizes the image displayed on the touch panel 130, the control unit 101 determines a part, which is visually recognized, of the image displayed on the touch panel 130 using the direction of the face of the user U, the direction of the visual line, or the like, as illustrated in FIG. 18.

Zone Z1: upper left area
Zone Z2: upper right area
Zone Z3: lower left area
Zone Z4: lower right area Here, although the touch panel 130 is divided into four areas, it is apparent that the touch panel 130 may be divided into areas whose number is larger than or smaller than four.

Figure 19A:
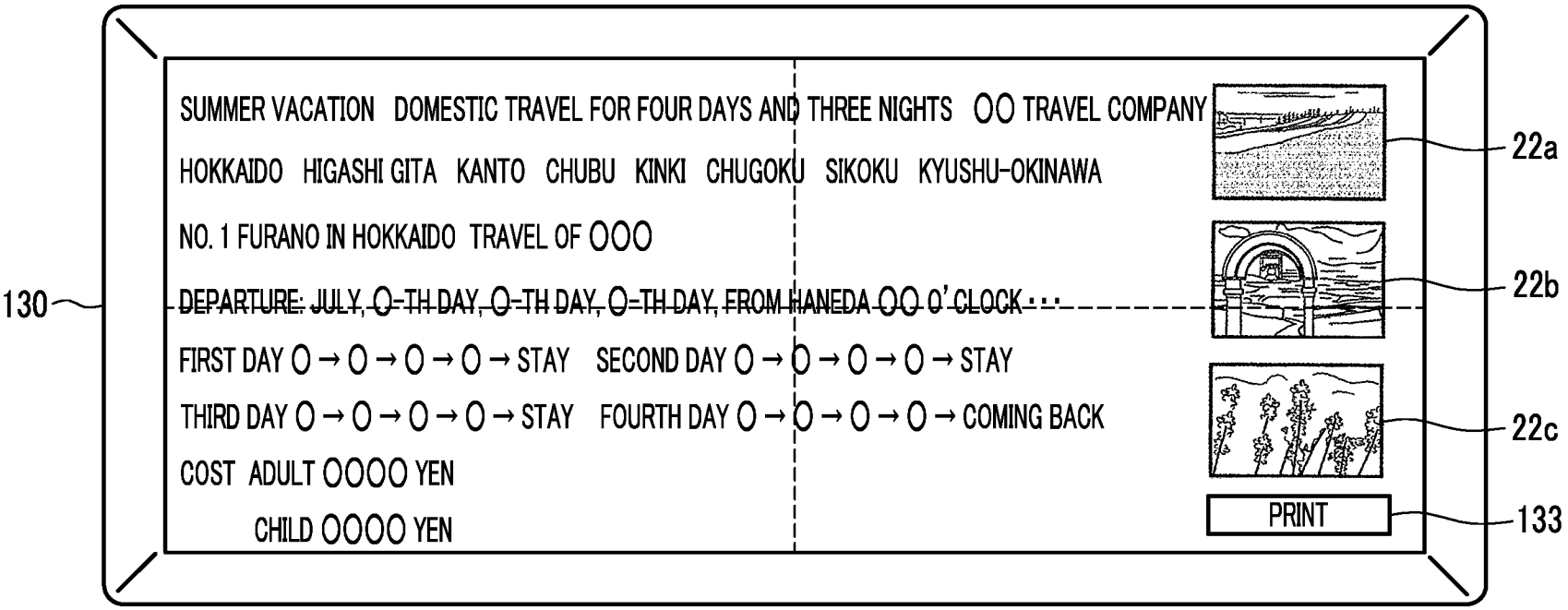
FIGS. 19A and 19B are configuration diagrams illustrating the touch panel of the image forming apparatus according to the fourth exemplary embodiment of the invention.
Figure 19B:
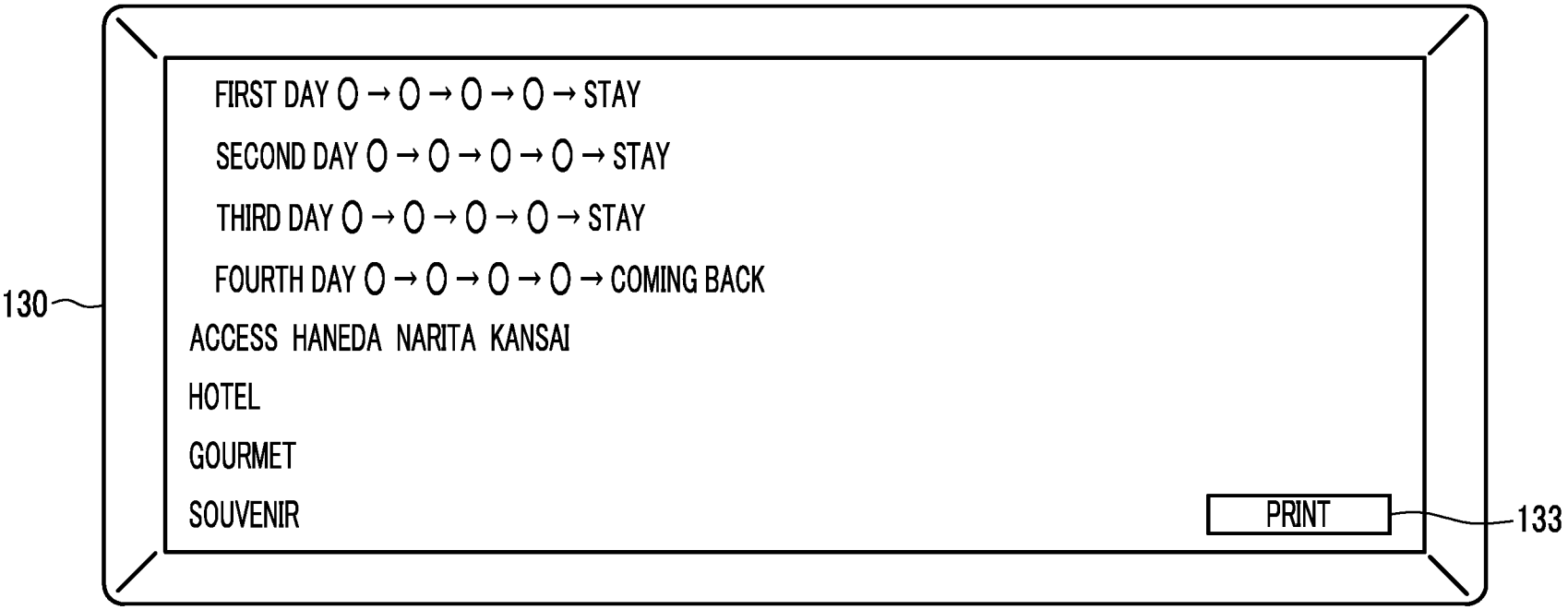

Here, in a case where the control unit 101 determines that the user visually recognizes, for example, an area of Z3 in the image displayed on the touch panel 130, the control unit 101 performs enlargement and display such that an image displayed in the area of Z3 of the image displayed on the touch panel 130 is displayed on the whole surface of the touch panel 130, as illustrated in FIGS. 19A and 19B.

At this time, the control unit 101 displays a relevant image which is related to the image displayed in the area of Z3 in the image displayed on the touch panel 130, together. Here, since an image displayed in an area of Z1 of the touch panel 130 indicates Furano in Hokkaido for four days and three nights, and a schedule of ○○○ travel, access to the travel, available hotels, gourmets, souvenirs, and the like are displayed, together, as the relevant information related to the schedule of the travel.

As above, according to the fourth exemplary embodiment, it is possible for the control unit 101 to display an image having a size corresponding to the direction of the face of the user U, compared to a case where an image having an identical size is displayed on the touch panel 130 regardless of the direction of the face of the user U.

Since other configurations and actions are the same as in the exemplary embodiment, the description thereof will not be repeated.

In the exemplary embodiment, a case where the display panel 20 is provided on an upper front surface of the apparatus main body 1*a* of the image forming apparatus 1 is described. However, it is apparent that a spot where the display panel 20 is provided may be a place other than the upper front surface of the apparatus main body 1*a*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image display apparatus comprising:
a display section displays an image;
a detection section that detects a location of a user;
a change section that changes an image to be displayed on the display section from an image for a first location to an image for a second location, the image for the first location and the image for the second location being images having an identical attribute, in a case where the location of the user, which is detected by the detection section, is changed from the first location to the second location; and
a second display section that is different from the display section,
wherein the second display section displays an image which has an identical attribute to the image to be displayed on the display section.

2. The image display apparatus according to claim 1,
wherein the image displayed on the second display section is acquired by increasing an information quantity from the image for the second location.

3. An image forming apparatus comprising:
an image display apparatus that is provided on an apparatus main body and displays an image; and
an image forming section that is provided on an inside of the apparatus main body and forms the image,
wherein the image display apparatus according to claim 2 is used as the image display apparatus.

4. The image display apparatus according to claim 1,
wherein, in a case where the image is displayed on the second display section, the image is not displayed on the display section.

5. An image forming apparatus comprising:
an image display apparatus that is provided on an apparatus main body and displays an image; and
an image forming section that is provided on an inside of the apparatus main body and forms the image,
wherein the image display apparatus according to claim 4 is used as the image display apparatus.

6. An image forming apparatus comprising:
an image display apparatus that is provided on an apparatus main body and displays an image; and
an image forming section that is provided on an inside of the apparatus main body and forms the image,
wherein the image display apparatus according to claim 1 is used as the image display apparatus.

* * * * *